US005157214A

United States Patent [19]

Nakanishi et al.

[11] Patent Number: 5,157,214

[45] Date of Patent: Oct. 20, 1992

[54] MUSICAL SOUND SYNTHESIZING APPARATUS

[75] Inventors: Masahiro Nakanishi, Yawata; Daisuke Mori, Kobe; Mizuho Seki, Hirakata; Katsuyoshi Fujii, Moriguchi; Masahiko Hatanaka, Kadoma, all of Japan

[73] Assignee: Matsushita Electric Industrial Co., Ltd., Osaka, Japan

[21] Appl. No.: 505,150

[22] Filed: Apr. 5, 1990

[30] Foreign Application Priority Data

| | | | |
|---|---|---|---|
| Apr. 10, 1989 | [JP] | Japan | 1-090130 |
| Apr. 10, 1989 | [JP] | Japan | 1-090134 |
| Aug. 22, 1989 | [JP] | Japan | 1-216407 |
| Dec. 4, 1989 | [JP] | Japan | 1-314745 |
| Jan. 19, 1990 | [JP] | Japan | 2-011310 |

[51] Int. Cl.[5] ..... G10H 7/02; G10H 5/07

[52] U.S. Cl. ..... 84/622; 84/659; 84/630; 84/DIG. 10; 84/DIG. 26

[58] Field of Search ..... 84/622-625, 84/659-661, 736, 630, DIG. 9, DIG. 10, DIG. 26; 364/724.01

[56] References Cited

U.S. PATENT DOCUMENTS

| | | | |
|---|---|---|---|
| 4,389,915 | 6/1983 | Bione | 84/DIG. 26 |
| 4,679,480 | 7/1987 | Suzuki | 84/DIG. 9 |
| 4,699,039 | 10/1987 | Oguri et al. | 84/622 |
| 4,736,663 | 4/1988 | Wawrzynek et al. | 84/DIG. 9 |
| 4,984,276 | 1/1991 | Smith | 84/630 X |

FOREIGN PATENT DOCUMENTS 6340199 2/1982 Japan .

*Primary Examiner*—William M. Shoop, Jr.
*Assistant Examiner*—Brian Sircus
*Attorney, Agent, or Firm*—Stevens, Davis, Miller & Mosher

[57] ABSTRACT

A musical sound synthesizing apparatus which simulates a sound generating mechanism of a string instrument by using an electronic circuit comprises a driver for applying data, an adder, a delay unit for storing data temporarily, a low pass filter for processing data, and a word length designating unit for designating a word length (address width) of the delay unit. The adder, delay unit and low pass filter form a loop-shaped circuit, with their corresponding input ends and output ends connected with each other. The word length designating unit corrects a word length of the delay unit in accordance with a phase delay of the low pass filter or in accordance with the number of stages of the pipeline structure of the loop. In the case where a musical sound of the type generated by touching or hitting strings is synthesized, the driver reads at least two series of data stored beforehand and applies the read data to one of the inputs to the adder. While, in the case where a musical sound of the type generated by rubbing strings is synthesized, the driver applies, to one of the inputs to the adder, data calculated on the basis of at least two data read out from mutually different addresses in the delay unit and data (corresponding to the velocity of a bow) inputted thereto externally.

6 Claims, 25 Drawing Sheets

| | $b_{13}$ | $b_{10}$ | | $b_0$ |
|---|---|---|---|---|
| DELAY AREA ADDRESS FORMAT | 0 0 | CH | $DD_k$ / $DD_{k-m}$ | |
| INPUT DATA AREA ADDRESS FORMAT | TA1 / TA2 | | | |
| PCM DATA AREA ADDRESS FORMAT | PA | | | |

| | | | | |
|---|---|---|---|---|
| INPUT DATA AREA HEADER ADDRESS FORMAT | 0 1 | all 0 | TSD | 0/1 |
| PCM DATA AREA HEADER ADDRESS FORMAT | 1 | all 0 | PSD | 0/1 |

MUSICAL SOUND SYNTHESIZING APPARATUS

BACKGROUND OF THE INVENTION

1. Field of the Invention

The present invention relates to a musical sound synthesizing apparatus which simulates a sound generating mechanism of a string instrument using an electronic circuit.

2. Description of the Related Art

Recently, many musical sound synthesizing apparatuses have been developed which utilize a digital electronic circuit such as an electronic piano or a synthesizer using advanced digital techniques. A music sound synthesizing apparatus has been proposed which analyzes a sound generating mechanism of an instrument and which realizes the mechanism using a digital electronic circuit, for example, as disclosed in Japanese Patent Publication Sho 63-40199, entitled "Signal Processor".

Referring to the drawings, the above musical sound synthesizing apparatus will be described. FIG. 26 is a block diagram of the apparatus which simulates the sound generating mechanism of a string instrument of the type in which the strings are touched, such as a guitar shown in FIGS. 28A, B and C and a string instrument of the type in which the strings are hit, such as a piano shown in FIGS. 29A, B and C, using an electronic digital circuit.

In FIG. 26, reference numeral 261 denotes an adder which adds input data and the data read from a delay unit 401, while reference numeral 262 denotes an adder which adds input data and the data read from a delay unit 269. The result of the addition from the adder 261 is temporarily stored in a delay unit 263, the data from which is processed by an inverter 265 and a low pass filter 266, and the resulting data is temporarily stored in a delay unit 269. The result of the addition from the adder 262 is temporarily stored in a delay unit 264, the data from which is processed by an inverter 267 and a low pass filter 268, and the resulting data is temporarily stored in a delay unit 401. The word length of the delay units 263 and 269 is of n/2 stages, while the word length of the delay units 264 and 401 is of m/2 stages. A junction unit 402 includes inverter 267 and low pass filter 268; a waveguide 403 includes delay units 401 and 264; a junction unit 404 includes adders 261 and 262; a waveguide 405 includes delay units 263 and 269; and a junction unit 406 includes inverter 265 and low pass filter 266. Input data is expressed by a data train TD(i) which is 0 except in the range of $0 \leqq i \leqq I$ where I is an integer which determines the train length of the input data. I is incremented at each of sample periods of Ts from the time (i=0) when the sound generation starts.

If the musical sound generating apparatus of FIG. 26 is made to correspond to a sound generating mechanism of an instrument of the type in which the strings are touched, shown in FIGS. 28A, B and C, the input data corresponds to the acceleration of a string given at a point B, while the time for which data is stored temporarily in the delay units 263, 269, and 264 401 correspond to the time required for the accelerations to propagate through the respective distances between the points B and C and between the points A and B. The processing operations by the inverter 265 and low pass filter 266 correspond to the influence of the reflection of the waves and cutoff of high frequencies (low pass filtering) at a support point C, while the processing operations by the inverter 267 and low pass filter 268 correspond to the influence of the reflection of the waves at point A and cutoff of high frequencies (low pass filtering).

FIG. 27 shows a circuit diagram of delay units 263, 264, 269 and 401. In FIG. 27, reference numeral 271 denotes a shift register which shifts data, stored temporarily therein, stage by stage in the output direction (rightward) in accordance with a system clock SCK (whose period corresponds to a sample period Ts) and which receives data at its input terminal (left terminal) synchronously with its shifting operation to output the data from its output terminal (right terminal); 272 denotes a delay unit which delays data output from adder 273 by one sample period Ts, the adder adding data output from shift register 271 and data output from a multiplier 276 which multiplies data output from delay unit 272 by an inverse of −a of the filter coefficiency; 274 denotes an adder which adds data output from delay unit 272 and data output from multiplier 275 which multiplies data output from adder 273 by a filter coefficient a. Alternatively, a memory which will be capable of storing a plurality of pieces of data temporarily and a circuit to manage the addresses of the memory may be used to perform a similar operation instead of shift register 271. The circuit portion of FIG. 27 except for shift register 271 is known generally as a first-order all-pass filter. The reason why the all pass filter is used in the delay unit is to improve the accuracy of a pitch by realizing a fractional delay. Therefore, a m/2-delay of delay units 264, 401 and n/2 delay of delay units 263 and 269 are treated as real numbers. The fractional delay corresponds to a time interval comprising a fraction of one sample period Ts.

FIGS. 28A, B and C schematically illustrate a sound generating mechanism of an instrument of the type in which a string supported at points A and C is touched. First, as shown in FIG. 28A, acceleration is generated at point B by picking up the string at point B and then releasing it. Then, as shown in FIG. 28B, the acceleration propagates in the directions of broken arrows with time. Further, as shown in FIG. 28C, the waves which have arrived at points A and C are reflected thereby and propagate again toward point B. By repetition of such operations, vibrations of the string occur. The acceleration propagating along the string will cause a barrel to vibrate at point C to thereby generate a sound. The conceivable influence on the propagating acceleration at points A and C is the reflection at the fixed end and the cutoff of high frequency components which will attenuate vibrations.

FIGS. 29A, B and C schematically illustrate a sound generating mechanism of an instrument of the type in which the strings are hit. In FIGS. 29A, B and C, the string is supported at points A and C. As shown in FIG. 29A, a displacement occurs at point B by hitting point B, for example, by a hammer of the piano. The displacement propagates in the directions of two broken arrows with time. The displacement propagating toward point A is reflected at once at point A, so that a displacement due to interference occurs as shown in FIG. 29B. As shown in FIG. 29C, the interference wave propagates toward point C and then reflection is repeated at points A and C to thereby cause vibrations of the string. The displacement propagating along the string vibrates the barrel at point C to thereby generate a sound. The conceivable influence on the propagating displacement at points A and C is reflection at the fixed end and the cutoff of high frequency components which will attenuate the vibrations.

FIG. 30 is a diagram of a circuit corresponding to the junction unit 404 of the musical sound synthesizing apparatus shown in FIG. 26. If the junction unit 404 is replaced by the circuit of FIG. 30, a sound generating mechanism of an instrument of the type where the strings are rubbed such as a violin is simulated.

In FIG. 30, reference numeral 301 denotes an adder which adds data $v_{ir}$ outputted from delay unit 269 and data $v_{il}$ outputted from delay unit 401; 302 denotes a subtracter which subtracts input data $v_b$ from the result $v_i$ of the addition by adder 301; 303 denotes a converter which reads acceleration data $\Delta v$ stored therein beforehand by using as an address the result v of the subtraction by the subtracter 302; 304 denotes an adder which adds data $v_{il}$ and acceleration data $\Delta v$; and 305 denotes an adder which adds data $v_{ir}$ and acceleration data $\Delta v$.

FIG. 31 is a characteristic diagram indicative of the state of $\Delta v$ stored in converter 303. In FIG. 31, the abscissae represents an address v input to converter 303; and the ordinate represents acceleration data $\Delta v$ read from the converter 303. The diagram represents, as $f(v)=\Delta v$ in an approximated form, the characteristic of a frictional force f(v) applied to the string from the bow where v is the relative velocity between the velocity $v_b$ of the bow and the velocity $v_i$ of the string and $\Delta v$ is the acceleration applied to a material point where the bow and the string contact.

FIG. 32 schematically illustrates a sound generating mechanism of an instrument of the type in which the string is rubbed. In FIG. 32, the string is supported at points A and B. A frictional force f(v) is generated at point B by drawing a bow at a speed of $v_b$. At this time, assume that the acceleration applied to point B is $\Delta v$. The speed $v_i$ of the string at point B is considered to be expressed by the sum of a velocity $v_{il}$ which has come back from point A and a velocity $v_{ir}$ which has come back from point C; namely, $v_i=v_{il}+v_{ir}$. The relative velocity between the string and bow is $v=v_i-v_b$. The relationship between the acceleration $\Delta v$ applied to the string and the relative velocity v between the string and bow is represented approximately by the characteristic diagram of FIG. 31. Assume that the velocity $v_i$ of the string at point B is 0 at the initial state. An acceleration of $\Delta v=f(-v_b)$ is applied to point B. The velocity $v_{or}=-v_{ol}=\Delta v$ propagates toward points C and B simultaneously, where $v_{or}$ is the velocity of the string propagating from point B to point C and $v_{ol}$ is the velocity of the string propagating from point B to point A. The propagating velocity is reflected at points A and C and comes back again to point B. The velocity $v_i$ of the string at the time is determined by the velocity which has come back. The value of the input acceleration $\Delta v$ is determined from the relationship between $v_i$ and $v_b$. The velocity $v_{or}$ propagating from point B to point C is $v_{or}=v_{il}+\Delta v$, while the velocity $v_{ol}$ propagating from point B to point A is $v_{ol}=v_{ir}+\Delta v$.

By repeating the above operations, the vibrations of the string occur. The velocity propagating along the string vibrates the barrel at point C to thereby generate a sound. The conceivable influence on the propagating velocity at point A and C is reflection due to the fixed end of the string and the cutoff of high frequency components which attenuates the vibrations.

The operation of the conventional music sound synthesizing apparatus having the above structure will now be described. First, the synthesization of a musical sound of the type produced by touching or hitting a string will be described with reference to FIG. 26, FIGS. 28A, B, C and FIGS. 29A, B, C. In FIGS. 28A, B, C and FIGS. 29A, B, C, an acceleration or a displacement is applied to point B by playing the instrument, for example, by touching or hitting the strings. The applied acceleration or displacement propagate toward points A and C and are reflected at those points (reversed and the high-frequency components are cut off) and comes back again to point B. By repeating those operations, a sound is generated. The period of the generated sound is the time required for the acceleration or displacement applied at point B to travel to points A and C and to come back to point B.

FIG. 26 shows an electronic digital circuit which realizes such sound generation. In FIG. 26, the acceleration or displacement applied to the string by the playing operation corresponds to input data which is propagated via waveguides 403 and 405 and processed (reversed and the high frequency components are cut off) by junctions 402 and 406. By repeating those operations, a synthetic sound is obtained corresponding to the vibration of the string.

The pitch P of the synthetic sound is given by $$P=fs/L \quad (1)$$

$$L=m+n+D \quad (2)$$

where fs is the sample frequency;

D is the sum of phase delays occurring in the low pass filters 266 and 268; and L is the total sum of delays in a loop constituted by delay units 263, 264, 269, 401; inverters 265, 267; low pass filters 266, 268 and adders 261, 262 of FIG. 26.

The synthesization of a musical sound of the type generated by rubbing a string, as shown in FIG. 32, will be described with reference to FIGS. 26, 30, 31 and 32. In FIG. 32, a frictional force f is generated at point B, by the playing operation, for example, by rubbing the string, the force f generates an acceleration $\Delta v$ applied to the string, the acceleration $\Delta v$ is applied to the velocity of the string at that time to thereby determine a new velocity of the string. The acceleration $\Delta v$ is obtained in an approximated form by the characteristic diagram of FIG. 31 and the following equations:

$$v_{or}=v_{il}+\Delta v \quad (3)$$

$$v_{ol}=v_{ir}+\Delta v \quad (4)$$

$$v_i=v_{il}+v_{ir} \quad (5)$$

$$\Delta v=f(v)=f(v_i-v_b) \quad (6)$$

The velocities of the string thus determined at point B propagate toward points A and C, are reflected by those points (reversed and the high frequency components are cut off) and come back to point B. By repeating those operations, a sound is generated.

FIG. 26 shows an electronic digital circuit which realizes such sound generation. (Junction 404 uses the circuit of FIG. 30.) In FIG. 26, the drawing velocity $v_b$ of the bow corresponds to input data. The input data $v_b$ and data on the velocity $v_i(=v_{il}+v_{ir})$ stored temporarily in waveguides 403 and 405 determine new velocities $v_{ol}$ and $v_{or}$ of the string, which new velocities are propagated by waveguides 403 and 405 and processed (reversed and the high frequency components are cut off) by junctions 402 and 406. The velocities $v_{il}$ and $v_{ir}$ of the string which have come back to junction 404 determine the next velocity of the string as velocity $v_i (=v_{il}+v_{ir})$. By repeating those operations, output data is obtained corresponding to vibrations of the string.

The above conventional structure has the following three problems:

(1) Since the delay units, inverters and low pass filters which process data are distributed at several points, the number of steps required for the synthesization of a musical sound is excessively large and therefore synthesized high-quality sound cannot be obtained;

(2) If the high-frequency component cutoff characteristic of the low pass filters is controlled to control the sound color, the factor L (in equations 1 and 2) would change to thereby cause the pitch of the synthetic sound to change;

(3) If the loop-like circuit comprising the waveguides and junctions is constituted as a pipeline configuration in order to increase the processing speed, a quantity of delay occurs which corresponds to the number of pipeline stages to thereby change the pitch; and (4) A sound similar to a hammer sound in a piano which is generated by an operation other than the vibrations of the strings cannot be synthesized.

SUMMARY OF THE INVENTION

It is therefore an object of the present invention to provide a musical sound synthesizing apparatus which has a simple circuit to produce no deviations in a pitch even if the high frequency cutoff characteristic of the low pass filter is controlled or even if the circuit is pipelined, and further to synthesize a sound generated by an operation other than vibrations of the strings.

In order to achieve the above object, a musical sound synthesizing apparatus according to the present invention includes a driver for outputting difference data TD[i]−TD[i−m], a low pass filter, an adder for adding the output from the driver and the output data from the low pass filter, and a delay unit for temporarily storing the result of the addition and the low pass filter processing data from the delay unit.

By such a structure, the result of the addition of the data from the driver and from the low pass filter is input to the delay unit. The data is then processed by the loop constituted by the delay unit, low pass filter and adder and is outputted to thereby synthesize a musical sound of the type produced by touching or hitting the string.

A musical sound synthesizing apparatus according to the present invention includes a low pass filter, a delay unit, a driver for calculating acceleration data Δv on the basis of input data $v_b$ thereto, data DD'[k] outputted from the low pass filter and data DD[m] outputted from the delay unit, and an adder for adding the acceleration data Δv and the data DD'[k] outputted from the low pass filter, the delay unit temporarily storing the result of the addition, the low pass filter processing the data DD[k] from the delay unit. The character k denotes an address value designating a particular output stage of the delay unit constituted by a shift register and an all-pass filter as in the prior art. The character m denotes an address which designates a position where a quantity of delay for m stages (for m sample periods) has occurred as compared with the input stage of the delay unit.

By such a structure, the acceleration data Δv calculated on the basis of the input data $v_b$ from the driver, the data DD'[k] from the low pass filter and the data DD[m] from the delay unit is input to the adder where the acceleration data Δv and the data DD'[k] from the low pass filter are added and the result is inputted to the delay unit for delaying purposes. The delayed data is processed again by the low pass filter and the resulting data is again inputted to the adder. By repeating those operations, a musical sound of the type generated by rubbing the strings is synthesized.

A musical sound synthesizing apparatus according to the present invention includes a driver for outputting difference data TD[i]−TD[i−m], a low pass filter, an adder for adding the output data from the driver and the data from the low pass filter, a delay unit for temporarily storing the result of the addition, the low pass filter processing the output from the delay unit, and a word length designating unit for correcting the word length of the delay unit in accordance with the control of the high frequency cutoff characteristic of the low pass filter.

By such a structure, the word length designating unit gives to the delay unit the word length designating data of the delay unit corrected by a filter coefficient for controlling the high frequency cutoff characteristic of the low pass filter to thereby maintain the pitch of a synthetic sound at a given value irrespective of the value of the filter coefficient.

A musical sound synthesizing apparatus according to the present invention includes a driver for outputting difference data TD[i]−TD[i−m], a low pass filter, an adder for adding the output data from the driver and the data from the low pass filter, a delay unit for temporarily storing the result of the addition, the low pass filter processing the output from the delay unit, the adder, delay unit, and low pass filter constituting a loop-like circuit, and a word length designating unit for correcting the word length of the delay unit using the number of pipeline stages of a pipeline into which the loop-like circuit.

The pipelined structure serves to subtract a word length corresponding to the number of pipeline stages from the word length of the delay unit.

A musical sound synthesizing apparatus according to the present invention includes a driver for outputting difference data TD[i]−TD[i−m], a low pass filter, an adder for adding the output data from the driver and the data from the low pass filter, a delay unit for temporarily storing the result of the addition, the low pass filter processing the output from the delay unit, and a PCM generator for synthesizing a sound generated by an operation other than vibrations of the string, and an adder.

By such a structure, the data from the delay (a synthetic sound corresponding to vibrations of the string) and data from the PCM generator (a synthetic sound other than vibration of the strings) can be added.

DETAILED DESCRIPTION OF THE PREFERRED EMBODIMENTS

Embodiments of the present invention will now be described with reference to the drawings. FIGS. 1-5 briefly illustrate the features of the musical sound synthesizing apparatus according to the present invention, and FIG. 6 and subsequent figures illustrate the details of the embodiments.

Figure 1:
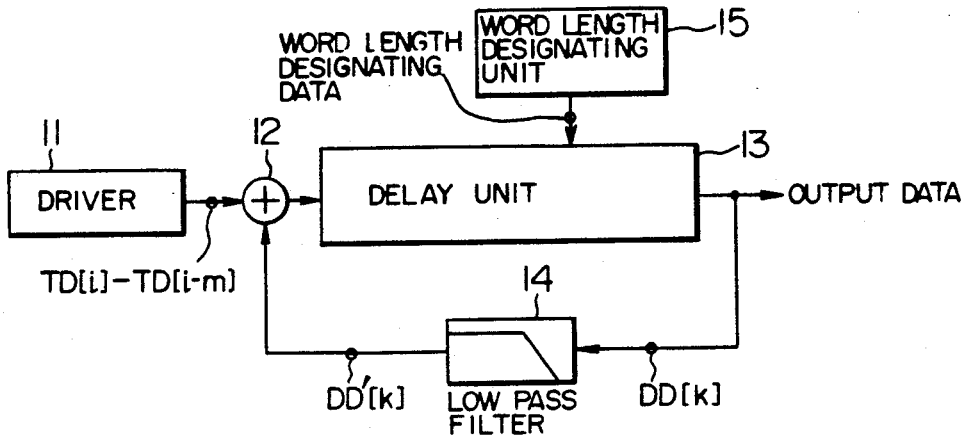
FIG. 1 is a block diagram of a musical sound synthesizing apparatus of a first embodiment of the present invention.

FIG. 1 is a block diagram of a musical sound synthesizing apparatus of a first embodiment of the present invention. The musical sound synthesizing apparatus of FIG. 1 synthesizes a musical sound of the type generated by touching or hitting the strings. In FIG. 1, reference numeral 11 denotes a driver which outputs data TD[i]−TD[i−m] to an adder 12 which adds data DD'[k] from a low pass filter 14 and data TD[i]−TD[i−m] from driver 11; 13 denotes a delay unit for temporarily storing the result of the addition by the adder 12; and 15 denotes a word length designating unit for controlling the word length of the delay unit 13, the low pass filter 14 processing data from the delay unit 13 and outputting the result to the adder 12. In TD[i−m], i is an integer value designating the address of the input data train and m is treated as a real number. Thus, i−m involves addressing data between adjacent sample points of the input data train. In this case, TD[i−m] is calculated by addressing the data between adjacent sample points using the process of interpolation, for example. In addition, the circuit arrangement shown in FIG. 1 may be modified so that low pass filter 14 is inserted after adder 12, and the data DD[k] outputted from delay unit 13 is inputted to adder 12. Further, the output data may be taken out from adder 12 or low pass filter 14.

Figure 2:
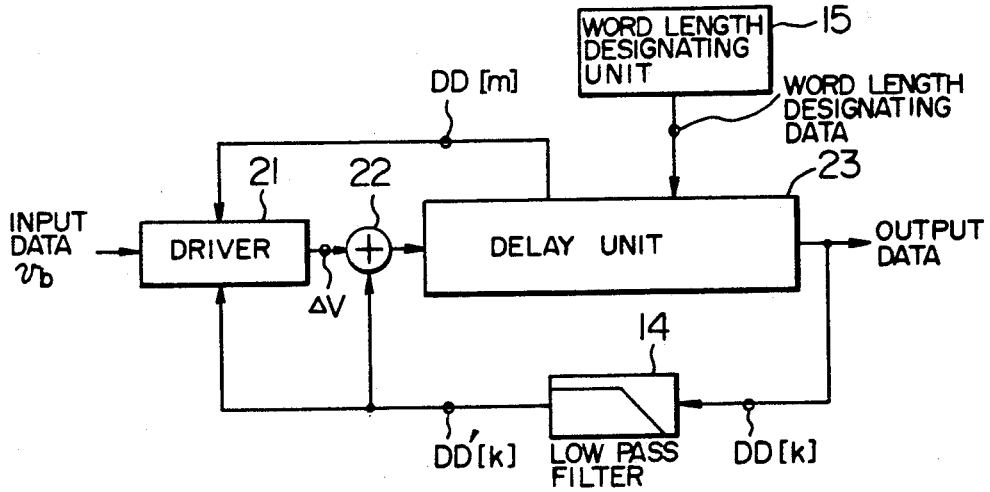
FIG. 2 is a block diagram of a musical sound synthesizing apparatus of a second embodiment of the present invention.
Figure 26:
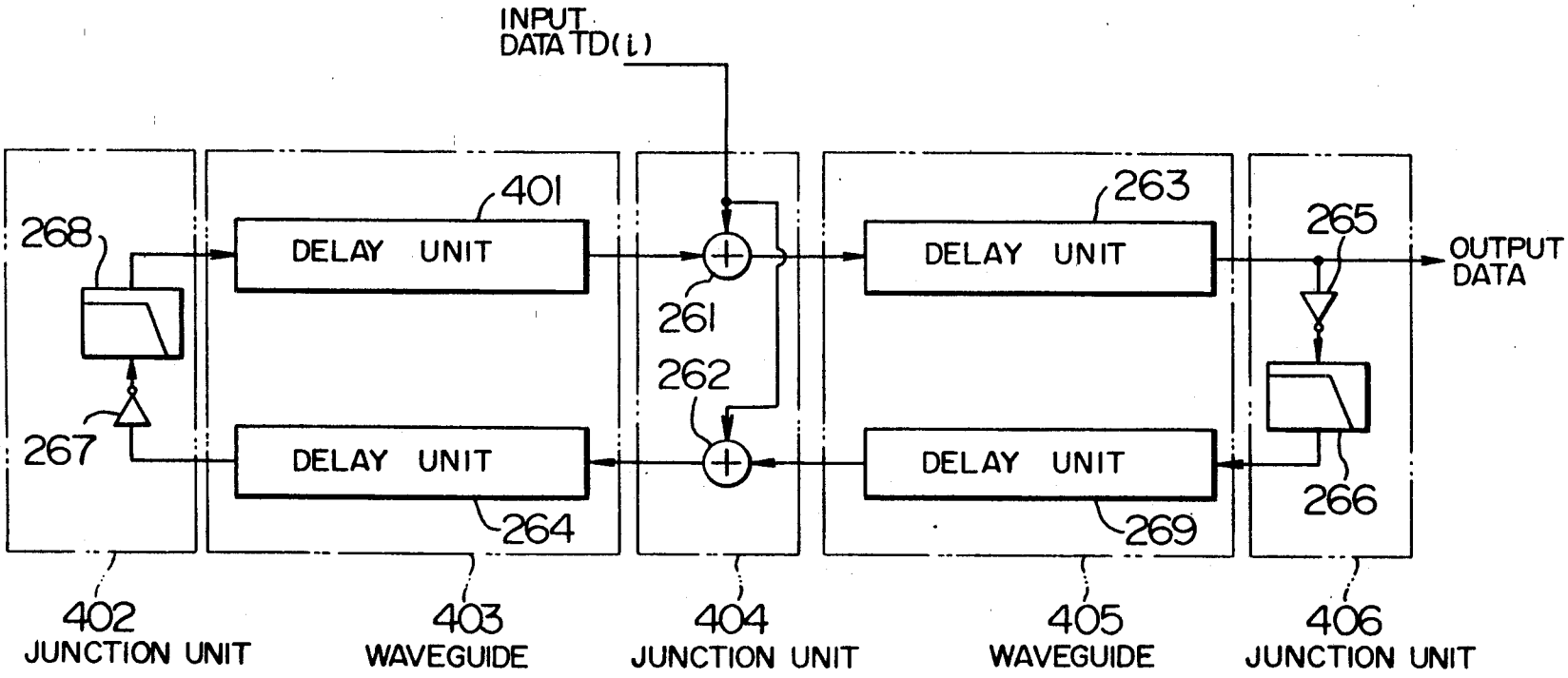
FIG. 26 PRIOR ART
FIG. 26 is a block diagram of a conventional musical sound synthesizing apparatus.

FIG. 2 is a block diagram of a music sound synthesizing apparatus of a second embodiment of the present invention. The apparatus of FIG. 2 is capable of synthesizing a musical sound of the type generated by rubbing the strings as in the conventional musical sound synthesizing apparatus where the junction unit 404 of FIG. 26 is replaced by the circuit of FIG. 30.

In FIG. 2, reference numeral 21 denotes a driver which calculates acceleration data Δv on the basis of input data $v_b$, data DD'[k] from a low pass filter 14 and data DD[m] from delay unit 23 which temporarily stores the result of the addition by an adder 22 and outputs data DD[m] and DD[K]. Driver 21 is a block which calculates the values of equations 3-5 as in the circuit of FIG. 30. Other blocks are similar to the corresponding ones in the apparatus of FIG. 1. DD[m] denote data inputted from adder 22 m unit times before and DD[k] is data inputted from adder 22 k unit times before. The word length k of delay unit 23 is controlled by word length designating unit 15, so that the pitch of a desired synthesized sound changes. The unit time means one sample period Ts.

Figure 3:
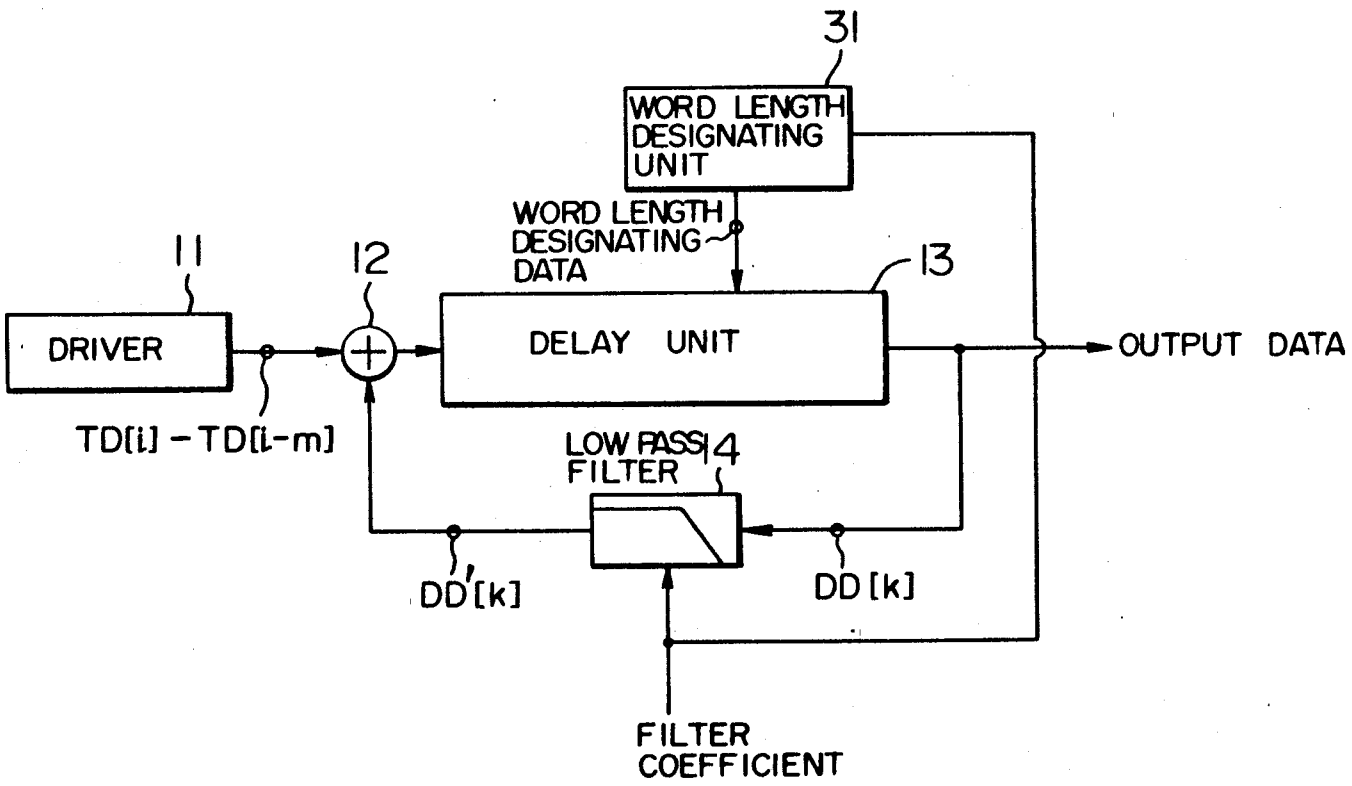
FIG. 3 is a block diagram of a musical sound synthesizing apparatus of a third embodiment of the present invention.

FIG. 3 is a block diagram of a musical sound synthesizing apparatus of a third embodiment of the present invention. In FIG. 3, reference numeral 31 denotes a word length designating unit which corrects the word length of the delay unit by using a filter coefficient for controlling the high frequency cutoff characteristic of low pass filter 14 and gives the corrected word length data to the delay unit. Other blocks are similar to the corresponding ones of the apparatus of FIG. 1. While the apparatus uses the word length designating unit 15 of the musical sound synthesizing apparatus of FIG. 1 as a word length designating unit 31, a similar effect will also be obtained by using the word length designating unit 15 of the apparatus of FIG. 2 as the word length designating unit 31. If the loop circuit comprising adder 12, delay unit 13 and low pass filter 14 is constituted as a pipeline in order to improve the processing speed, a quantity of delay for the number of pipeline stages increases corresponding to the total sum L of delays in the loop circuit (see equation 2) (and hence the pitch is reduced), so that the word length designating unit 31 should have a function of subtracting beforehand the number of pipeline stages from the word length of the delay unit to provide the word length designating data.

Figure 4:
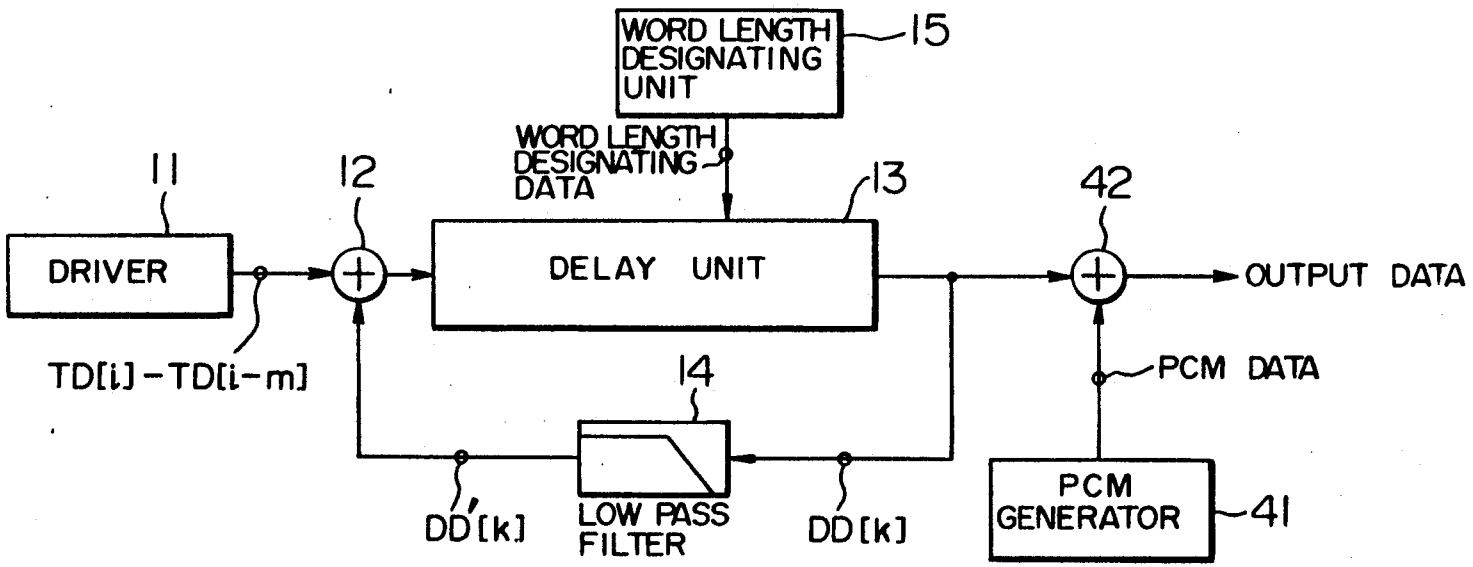
FIG. 4 is a block diagram of a musical sound synthesizing apparatus of a fourth embodiment of the present invention.

FIG. 4 is a block diagram of a musical sound synthesizing apparatus of a fourth embodiment of the present invention. In FIG. 4, reference numeral 41 denotes a PCM generator which synthesizes a sound such as that generated by an operation other than vibrations of a string such as a hammer sound generated in a piano; and 42 denotes an adder which adds PCM data from the PCM generator 41 and data from delay unit 13 and outputs the result of the addition as the output data. While the present embodiment includes the combination of the musical sound synthesizing apparatus of FIG. 1, adder 42 and PCM generator 41, a similar effect may be obtained by adding adder 42 and PCM generator 41 to the apparatus of FIG. 2.

Figure 5:
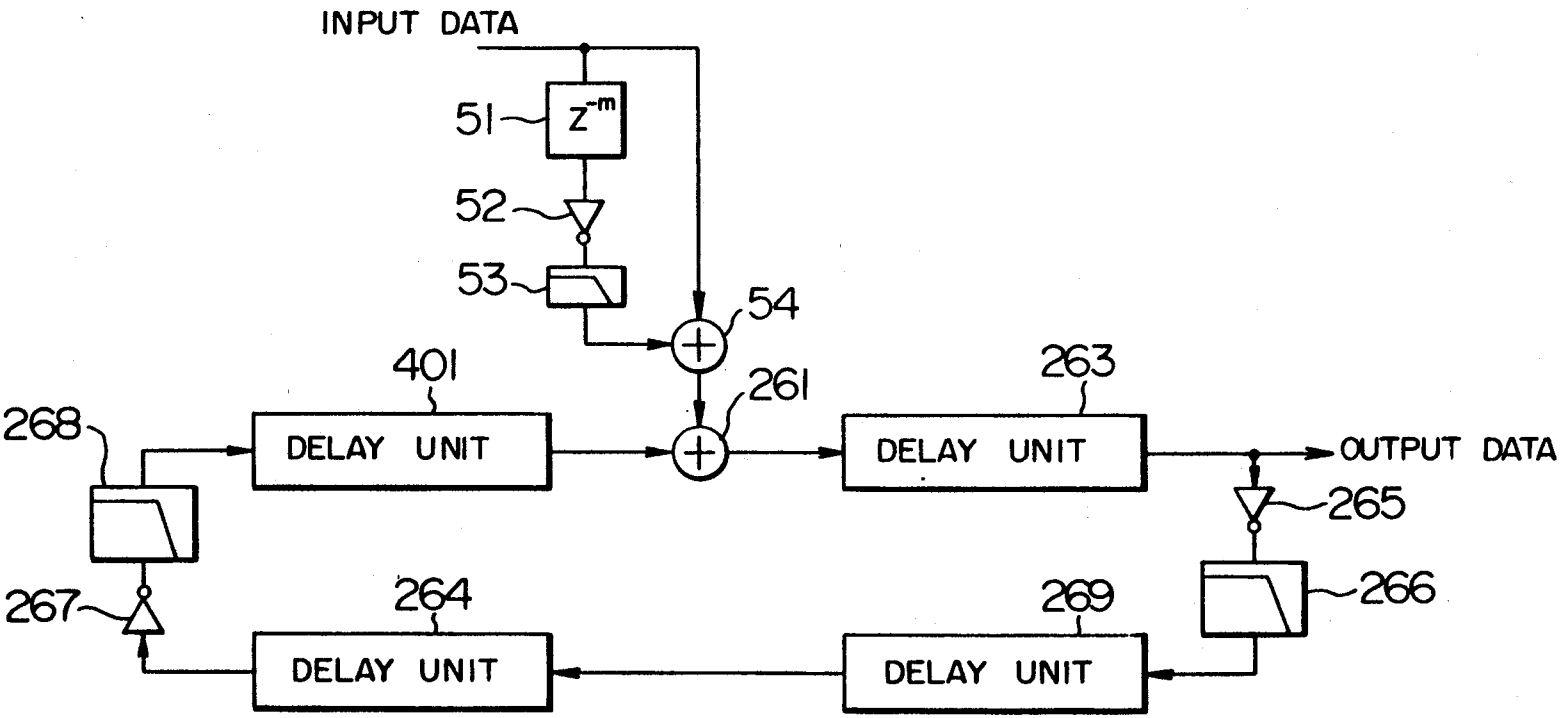
FIG. 5 is a circuit diagram for introducing the circuit diagram of the first embodiment on the basis of the structure of a conventional musical sound synthesizing apparatus shown in FIG. 26.

FIG. 5 shows a musical sound synthesizing apparatus having a simple circuit structure such as that shown in FIG. 1, obtained by modifying the conventional musical sound synthesizing apparatus of FIG. 26, so as to provide a waveform equal to that of the output data from the apparatus of FIG. 26.

In FIG. 5, reference numeral 51 denotes a delay unit which delays input data TD[i] thereto by m stages; 52 denotes an inverter which inverts data from delay unit 51; 53 denotes a low pass filter for cutting off high frequency components of data from inverter 52; and 54 denotes an adder which adds input data TD[i] and data from low pass filter 53. Other blocks are similar to the corresponding ones of the conventional apparatus of FIG. 26. The musical sound synthesizing apparatus of FIG. 1 is obtained by modifying the apparatus of FIG. 5 as follows. First, delay units 263, 264, 269 and 401 are collected together like delay unit 13 of FIG. 1. Further, low pass filters 266 and 268 are also collected together like low pass filter 14 of FIG. 1. If inverters 265 and 267 are collected together, cancellation occurs. The characteristic of low pass filter 14 is assumed to be equal to the characteristic of series-connected low pass filters 266 and 268. Low pass filter 53 is negligible because input data passes therethrough only once, and as a result the data input to adder 261 becomes TD[i]−TD[i−m]. Thus, the circuit including delay unit 51, inverter 52 and adder 54 can be represented by driver 11 of FIG. 1. As will be understood from the above description, the musical sound synthesizing apparatus of FIG. 1 is capable of synthesizing a musical sound of the type generated by touching or hitting strings like the conventional apparatus of FIG. 26.

Figure 30:
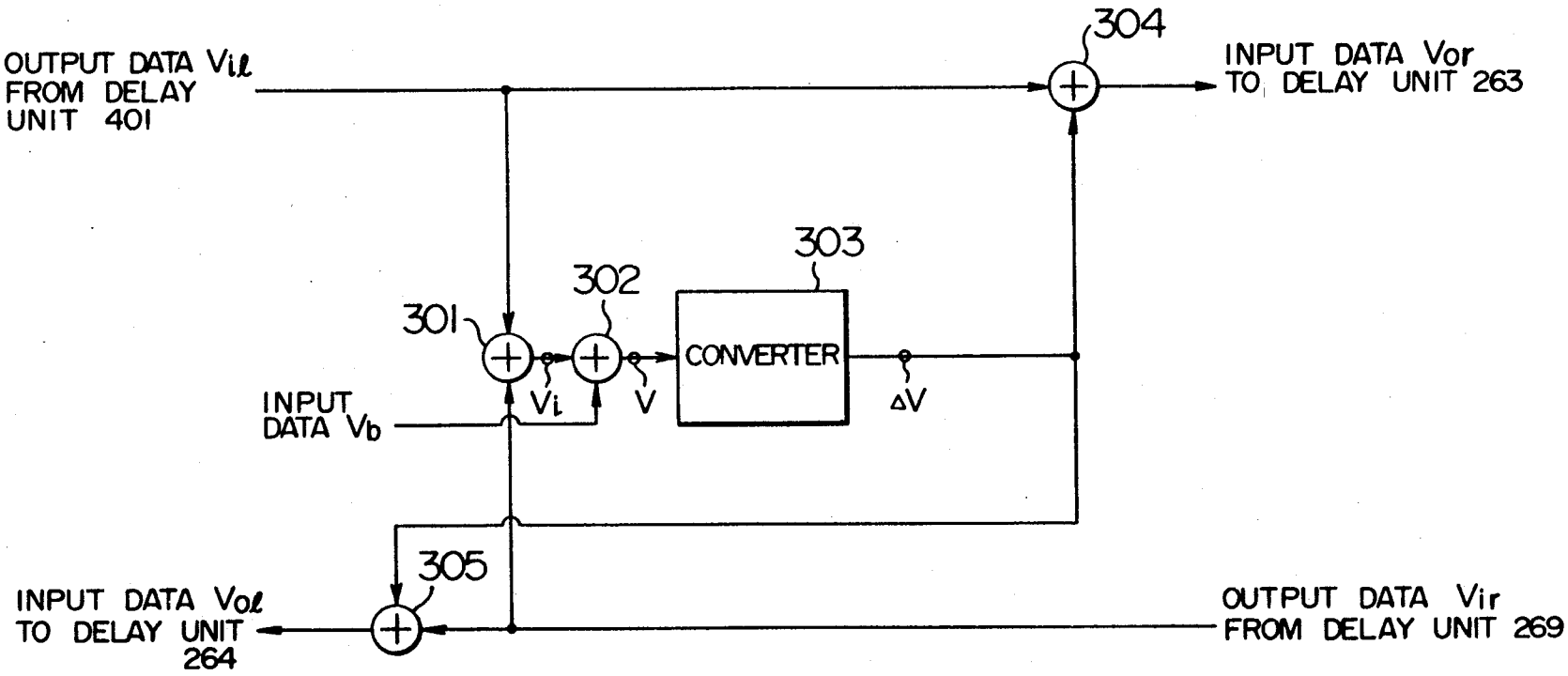
FIG. 30 PRIOR ART
FIG. 30 is a diagram of a circuit corresponding to junction unit 404 of the synthesizing apparatus of FIG. 26.
Figure 32:
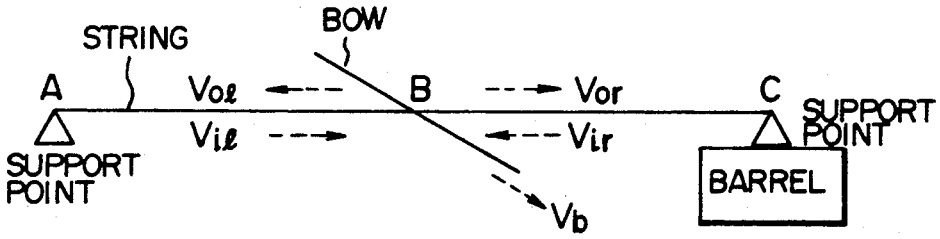
FIG. 32 PRIOR ART
FIG. 32 schematically illustrates a sound generating mechanism of an instrument of the type in which strings are rubbed.

The musical sound synthesizing apparatus of FIG. 2 is an approximate modification of a musical sound synthesizing apparatus which is formed by replacing the junction unit 404 of the conventional apparatus of FIG. 26 by the circuit of FIG. 30. In the conventional apparatus, Δv was calculated in accordance with equations 3–5. In this case, the velocity v of the string is the sum of the velocity $v_{il}$ which has come back by reflection from point A of FIG. 32 and the velocity $v_{ir}$ which has come back by reflection from point C. In contrast, in the musical sound synthesizing apparatus of FIG. 2, the velocity v of the string was considered to be represented by the sum (equation 7) of the velocity which determines the vibrating periods of the string (the main vibrating velocity is expressed by $v_m$ which corresponds to DD'[k] in FIG. 2) and the velocity which determines the position where a bow rubs the string (for simplifying purposes, the velocity reflected at point A is expressed by $v_a$ in FIG. 32 corresponding to DD[m] in FIG. 2). Characters $v_a$ and $v_{il}$ are both the velocities reflected from point A. Since $v_{il}$ is added to Δv in adder 304 as shown in FIG. 30, it exists for the time interval from the sound generation to the sound termination. Since $v_a$ is not added in the loop which includes the adder 22, delay unit 23 and low pass filter 14 as shown in FIG. 2, it becomes a velocity which is referred to as an element to determine Δv only once. In other words, $v_a$ is a value which is referred to only when the velocity generated by friction between the bow and the string is reflected at point A and comes back to point B again, and is attenuated by low pass filter 14 (corresponding to points A and C of FIG. 32) in its subsequent reflection and its contribution to the determination of Δv is lowered so that it should be neglected in the second and subsequent reflections:

$$v = v_m + v_a \tag{7}$$

Therefore, $$v = DD'[k] + DD'[m] \tag{8}$$

The equation which defines Δv is given by equation 6 as in the conventional musical sound synthesizing apparatus.

Figure 6:
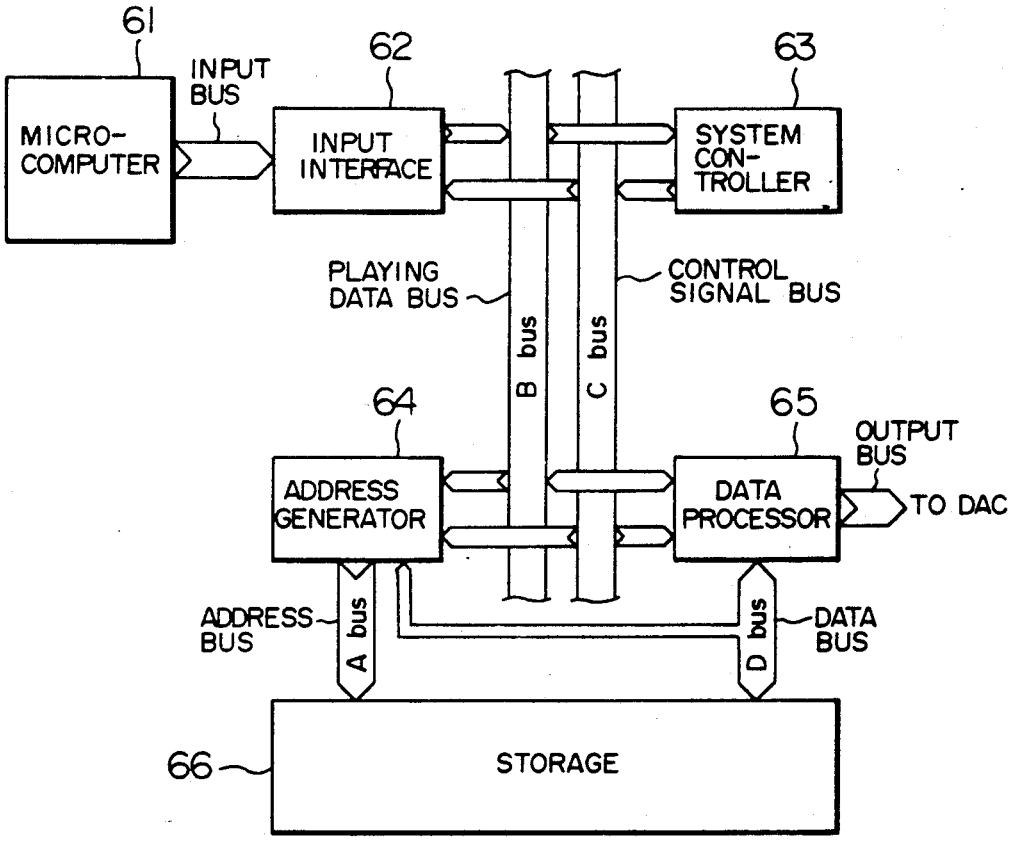
FIG. 6 is a circuit diagram of a musical sound synthesizing apparatus including all the features of the inventive musical sound synthesizing apparatus of FIGS. 1-4.

FIG. 6 shows a circuit in which the musical sound synthesizing apparatus shown in FIGS. 1–4 are included collectively. Due to the circuit configuration, the operation of the circuit of FIG. 6 differs in operation sequence from that of the apparatus of FIGS. 1–4. The sequence of operations of the circuit of FIG. 6 will be outlined with reference to FIG. 1. First, delayed data is read from delay unit 13 (corresponding to storage 66) and added to the data (stored in storage 66) from driver 11. The result of the addition is outputted as the output data to DAC, and processed by low pass filter 14 and further by all-pass filter 277 of delay unit 13. Finally, the resulting data is stored in delay unit 13. By such operations, one sample output data is synthesized. In FIGS. 1–4, while the output data which is added to PCM data in FIG. 4 is fetched from delay units 13 and 23, it may be fetched from any one of adders 12, 22; delay units 13, 23; and low pass filter 14 constituting the loop. For convenience's sake, the respective symbols of data in the apparatus of FIGS. 1–4 will be changed hereinafter as follows:

$DD[k] \rightarrow DD_k$
$DD[m] \rightarrow DD_{k-m}$
$TD[i] \rightarrow TD1$
$TD[i-m] \rightarrow TD2$ In FIG. 6, reference numeral 61 denotes a microcomputer which inputs various pieces of playing data into input interface 62 in accordance with playing operations; 62 denotes an input interface which stores playing data inputted from microcomputer 61 and outputs the pieces of playing data to a playing data bus Bbus on a time-sharing basis; 63 denotes a system controller which generates various control signals in the present circuit; 64 denotes an address generator which generates addresses for storage 66; and 65 denotes a processor which processes playing data from input interface 62, delayed data from storage 66, drive data, and PCM data, the storage 66 storing delayed data, drive data and PCM data. Data TD[i]−TD[i−m] inputted to adder 12 from driver 11 of FIG. 1 corresponds to the drive data in FIG. 6. The input data $v_b$ in FIG. 2 corresponds to one of the pieces of playing data from microprocessor 61 of FIG. 6. Adders 12, 22, 42, low pass filter 14 and driver 21 correspond to data processor 65; and word length designating units 15, 31 correspond to address generator 64. The microprocessor 61 has the word length correcting function for the filter coefficient of word length designating unit 31 and the number of pipeline stages.

Figure 7:
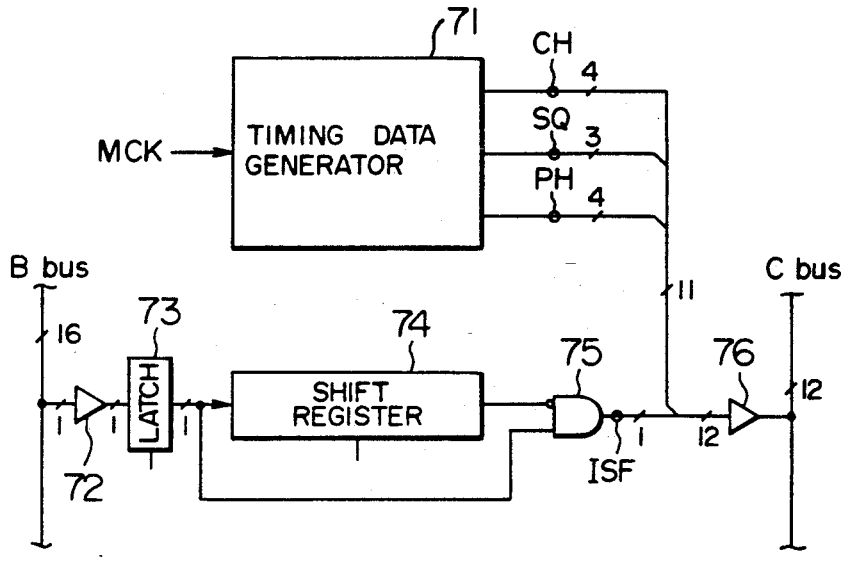
FIG. 7 is a circuit diagram of a system control unit 63.

FIG. 7 is a circuit diagram of system controller 63. In FIG. 7, reference 71 denotes a timing data generator which generates data CH indicative of channels 0–15 as shown in FIG. 8 in accordance with a master clock MCK, data SQ which divides one channel into 8 time slots having sequence numbers 0–7, and data PH which divides one sequence into 4 time slots; 72 denotes a buffer which buffers LSB data on Bbus; 73 denotes a latch which latches the output of buffer 72 (Kon of playing data DT0 of FIG. 12; 74 denotes a shift register which delays Kon for 16 channels; 75 denotes an AND gate which ANDs the inverse of the output of shift register 74 and the output of latch 73; and 76 denotes a buffer which buffers the outputs from timing data generator 71 and from AND gate 75.

Figure 8:
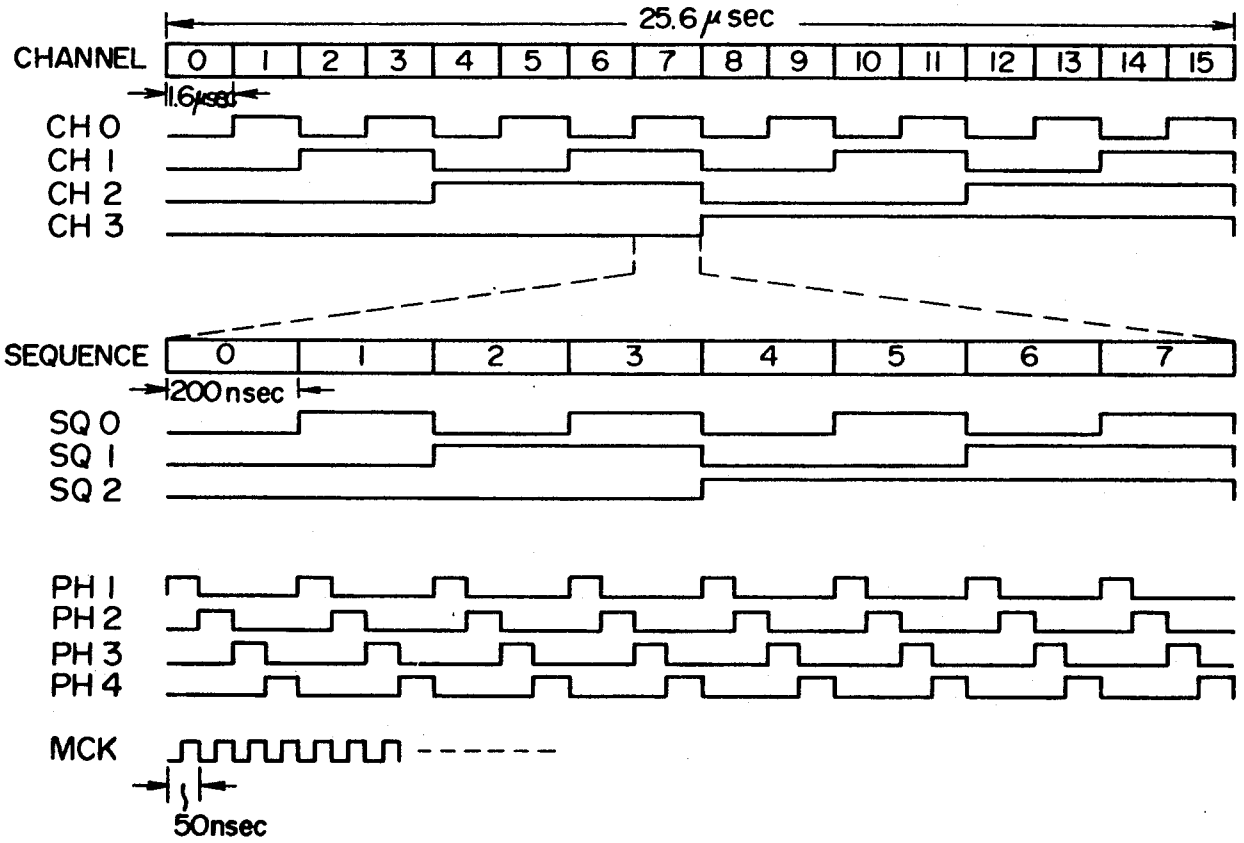
FIG. 8 is a timing chart indicative of the operation of the system control unit 63.

FIG. 8 is a timing chart for CH, SQ and PH outputted from timing data generator 71. In FIG. 8, assuming that a master clock MCK operates at 20 MHz, one period of MCK is 50 nanoseconds, the time interval of one sequence is 200 nanoseconds, the time interval of one channel is 1.6 microseconds, and one sample period is 25.6 microseconds. Therefore, the sample frequency fs is on the order of 39 kHz and the maximum number of channels which generate sounds simultaneously is 16.

Figure 9:
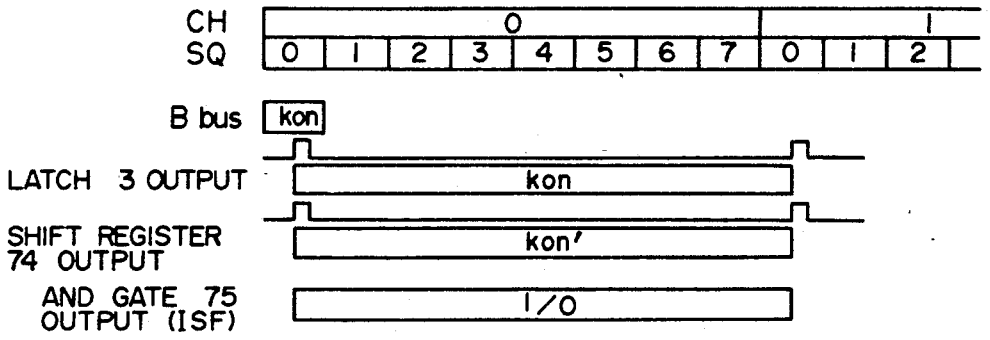
FIG. 9 is a timing chart indicative of the operation of the system control unit 63.

FIG. 9 is a timing chart indicative of the timing at which the output ISF of AND gate 75 is generated. In FIG. 9, the output ISF of AND gate 75 is a flag whose value is 1 when the value of the preceding kon (kon') is 0 (when no sound generation is commanded) and the current value of kon is 1 (sound generation is commanded). Therefore, otherwise (for example, both the preceding and current values of kon are 1), the value of LSF is 0. If the value of ISF is 1, address generator 64 prepares for synthesization such as reading input data TD1 and the end and start addresses of PCm data PD stored in the header (FIG. 22A) of storage 66. When the value of ISF is 0, the regular synthesizing operation is performed.

Figure 10:
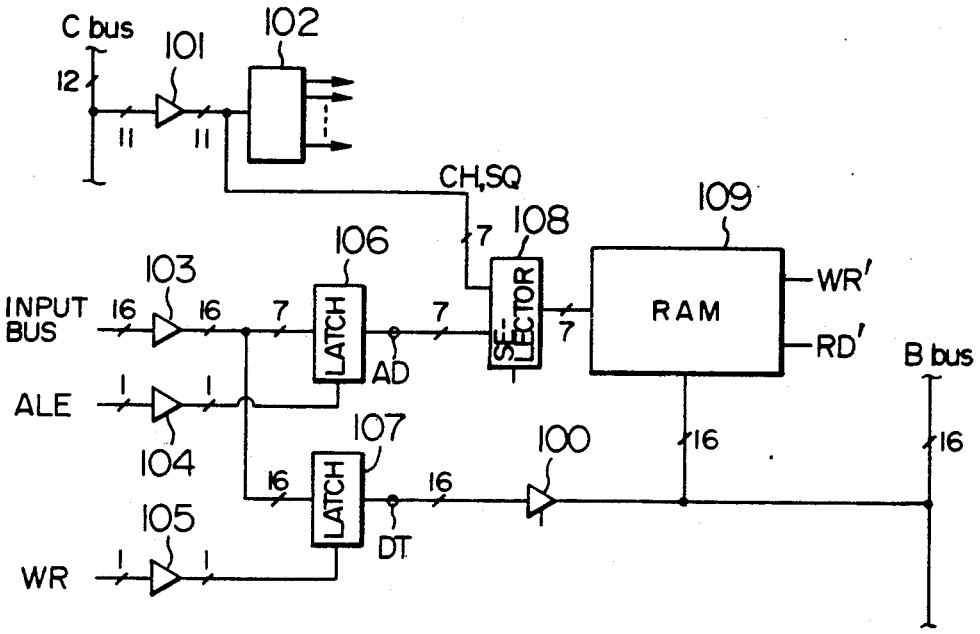
FIG. 10 is a circuit diagram of an input interface unit 62.

FIG. 10 is a circuit diagram of input interface 62 which functions as an interface because the timing of output of the playing data from microcomputer 61 in FIG. 6 is asynchronous with the timing of synthesization by other blocks. In FIG. 10, reference numeral 101 denotes a buffer which buffers Cbus; 102 denotes a control signal generator which generates a control signal in accordance with the output from buffer 101; 103 denotes a buffer which buffers the input bus; 104 denotes a buffer which buffers an address latch enable signal ALE; 105 denotes a buffer which buffers a write signal WR; 106 denotes a latch which latches the output of the buffer 103 with the output of buffer 104; 107 denotes a latch which latches the output of buffer 103 with the output of buffer 105; 108 denotes a selector which selects as an address the output from the latch 106 when data is written into RAM 109 and selects as an address data CH and SQ outputted from buffer 101 when data is read out of RAM 109 which stores playing data DT shown in FIG. 12; and 100 denotes a 3-state buffer which becomes high impedance when data is read out of RAM 109.

Figure 11:
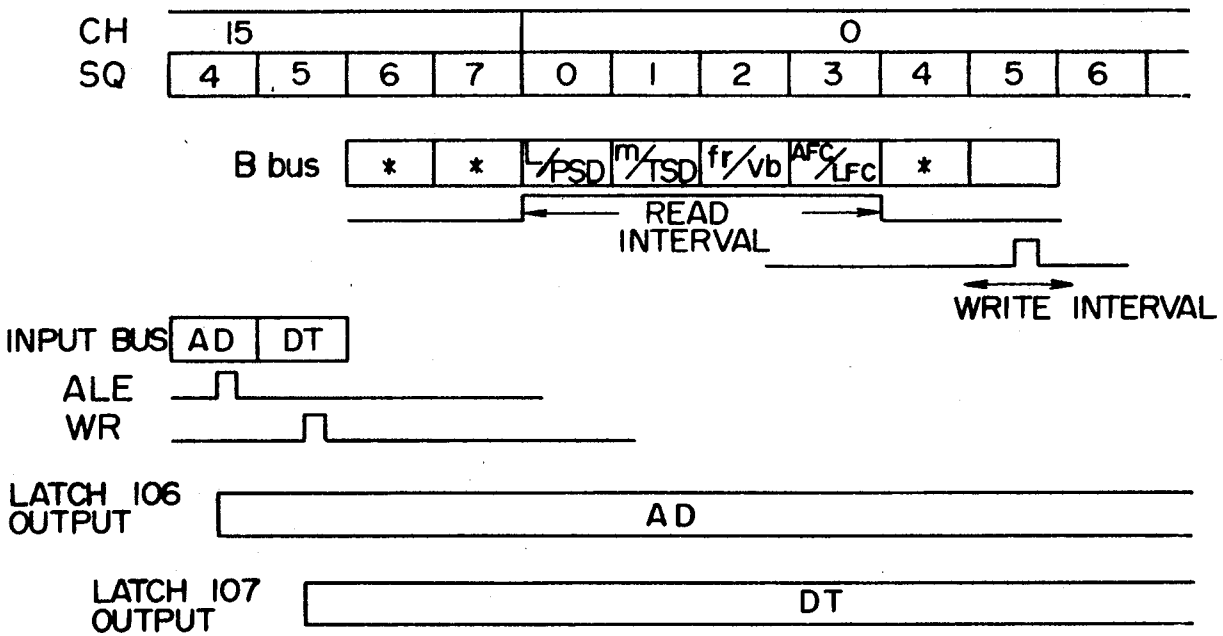
FIG. 11 is a timing chart indicative of the operation of the input interface 62.

FIG. 11 is a timing chart indicative of the operations of the respective elements of input interface 62 and write/read timing for RAM 109. In FIG. 11, SQ 0–3 denote an interval during which data is read out of RAM 109; and SQ 5 denotes an interval during which data is written into RAM 109.

Figure 12:
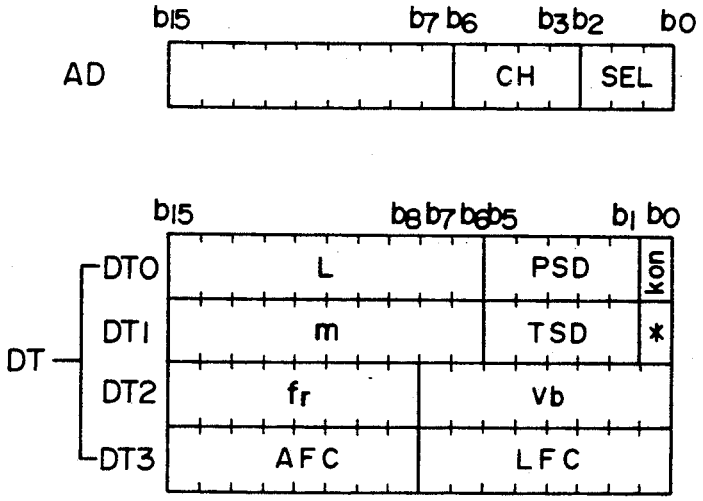
FIG. 12 shows the format of playing data.
Figure 31:
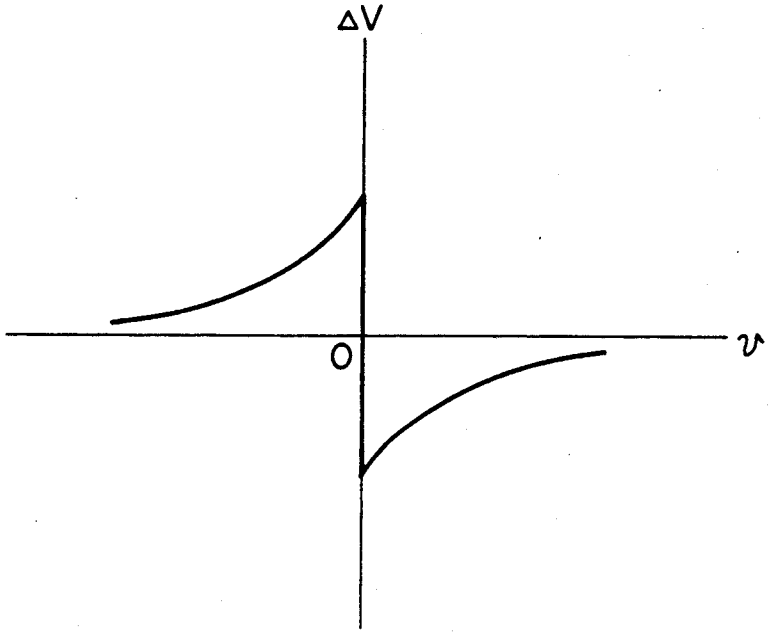
FIG. 31 PRIOR ART
FIG. 31 is a characteristic diagram indicative of the status of data Δv stored in a table 303 of FIG. 30.

FIG. 12 is the format of playing data in which AD denotes an address given by microcomputer 61 to input interface 62; DT denotes playing data; SEL in b0–2 denotes a bit to select DT0–DT3 as playing data; and CH in b3–6 denotes a bit indicative of a channel where synthesization is designated. Reference characters kon in b0 of DT0 denote a bit commanding sound generation; PSD in b1–5 denotes a bit designating an area in storage 66 for storing data on a sound (PCM data) other than vibration of strings; and L in b6–15 denotes a bit designating a word length per channel of a delay area of storage 66 corresponding to delay units 13 and 23. TSD in b1–5 of DT1 denotes a bit designating an area for drive data (input data TD[i]) in storage 66 corresponding to the output of driver 11 shown in FIGS. 1, 3 and 4; and m in b6–15 denotes a bit designating address m in delay unit 23. $v_b$ in b0–7 of DT2 denotes a bit corresponding to input data to drive 21 of the apparatus of FIG. 2, and fr in b8–15 denotes a bit corresponding to the maximum value of Δv in the characteristic diagram of FIG. 31. LFC in b0–7 of DT3 denotes the filter coefficient of low pass filter of FIG. 21; and AFC in b8–15 denotes the filter coefficient of the all-pass filter of FIG. 20. These filters are provided in the data processor 65 as mentioned above.

Figure 13:
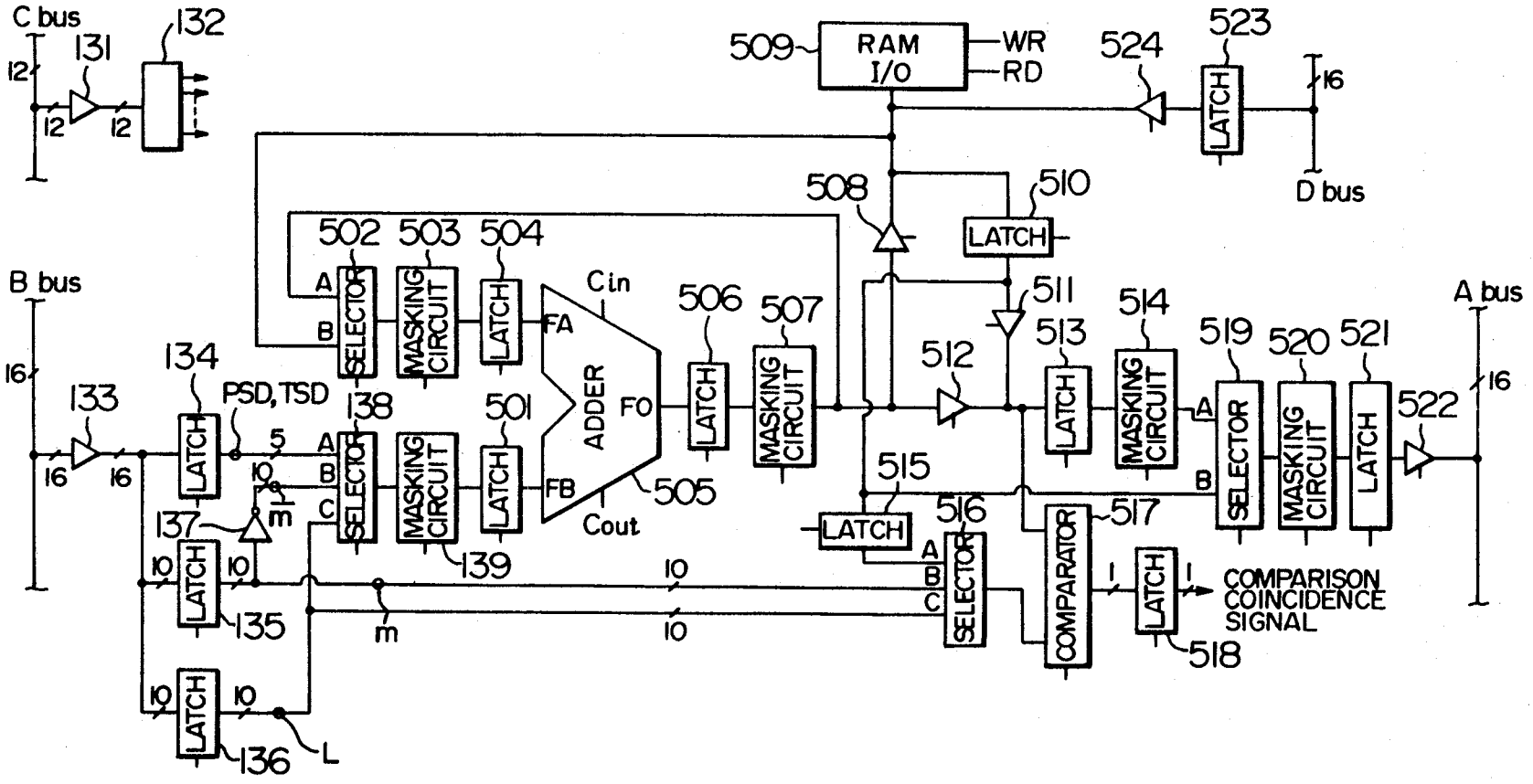
FIG. 13 is a circuit diagram of an address generator 64.
Figures 22A, 22B, 22C:
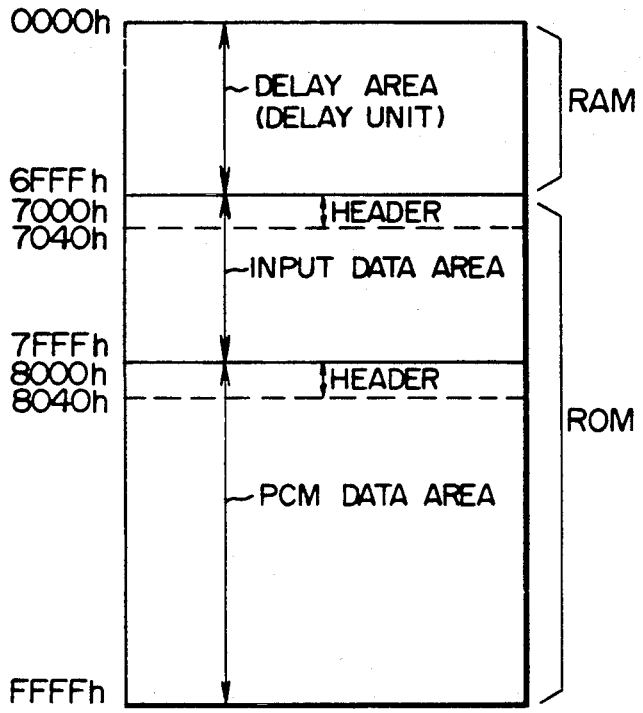
FIG. 22A shows a memory map of a storage 66.
FIGS. 22B and C show an address format of storage 66.

FIG. 13 shows the circuit of address generator 64 in which reference numeral 131 denotes a buffer which buffers Cbus; 132 denotes a control signal generator which generates a control signal in accordance with the output of buffer 131; 133 denotes a buffer which buffers Bbus and fetches playing data shown in FIG. 12; 134 denotes a latch which latches PSD and TSD of the fetched playing data; 135 denotes a latch which latches m of the playing data; 136 denotes a latch which latches L of the playing data; 137 denotes an inverter which inverts m to $\overline{m}$; 138 denotes a selector which selects PSD, TSD or $\overline{m}$ or L; 139 denotes a masking circuit which resets to 0 the B input value to adder 505; 501 denotes a latch which latches the output of the masking circuit 139; 502 denotes a selector which selects the output of the masking circuit 507 or the output of 3-state buffer 508; 503 denotes a masking circuit which resets the A input to adder 505 when the value of ISF in FIG. 9 is 1, the adder incrementing the address $DA_k$ of delayed data $DD_k$, the address PA of PCM data PD, or the addresses TA1, TA2 of input data TD1, TD2; 504 denotes a latch which latches the output of the masking circuit 503; 506 denotes a latch which latches the result of the addition; 507 denotes a masking circuit which resets the respective data addresses when $DA_k$ has reached the word length of L or when PA has reached the last address EPA of PCM data, or when TA1 has reached the last address ETA of the input data; 508 denotes a 3-state buffer which causes $DA_k$ PA, TA1 to pass therethrough when they are written into RAM 509 and, otherwise, becomes high impedance; 509 denotes a RAM which temporarily stores $DA_k$, EPA, PA, ETA and TA1; 510 denotes a latch which latches $DA_k$, EPA, PA, ETA, TA1 read from RAM 509; 511 denotes a 3-state buffer which inputs the output of latch 510 to latch 513; 512 denotes a 3-state buffer which inputs the output of masking circuit 507 to latch 513 which latches the outputs of 3-state buffers 511 and 512; 514 denotes a masking circuit which masks, when the value of ISF is 1, the most significant ten bits of each of HAP (the header address of PCM data area, see FIG. 22A) and HAT (the header address of drive data area, see FIG. 22A) as shown in FIG. 22C; 515 denotes a latch which latches the outputs EPA, ETA of latch 510; 516 denotes a selector which selects one of the outputs EPA, ETA of latch 515, the output m of latch 135 or the output L of latch 136; 517 denotes a comparator which compares $DA_k$ and L, $DA_{k-m}$ and L, PA and EPA, TA1 and ETA, TA1 and m, TA2 and ETA, respectively; 518 denotes a latch which latches a comparison coincidence signal generated when coincidence occurs; 519 denotes a selector which usually selects the A input, and selects B inputs (EPA, ETA) when PA, TA1 and TA2 have reached EPA, ETA and ETA, respectively; 520 denotes a masking circuit which masks the most significant six bits of $DA_k$ and $DA_{k-m}$, as shown in FIG. 22B; 521 denotes a latch which latches the output of masking circuit 520; 522 denotes a 3-state buffer which transmit the output of latch 521 to Abus; 523 denotes a latch which latches EPA (the end address of PCM data), SPA (the start address of PCM data), ETA (the end address of input data) and STA (the start address of the input data) read out of storage 66 via Dbus when the value of ISF is 1; and 524 denotes a 3-state buffer which writes the output of latch 523 into RAM 509.

Figure 14:
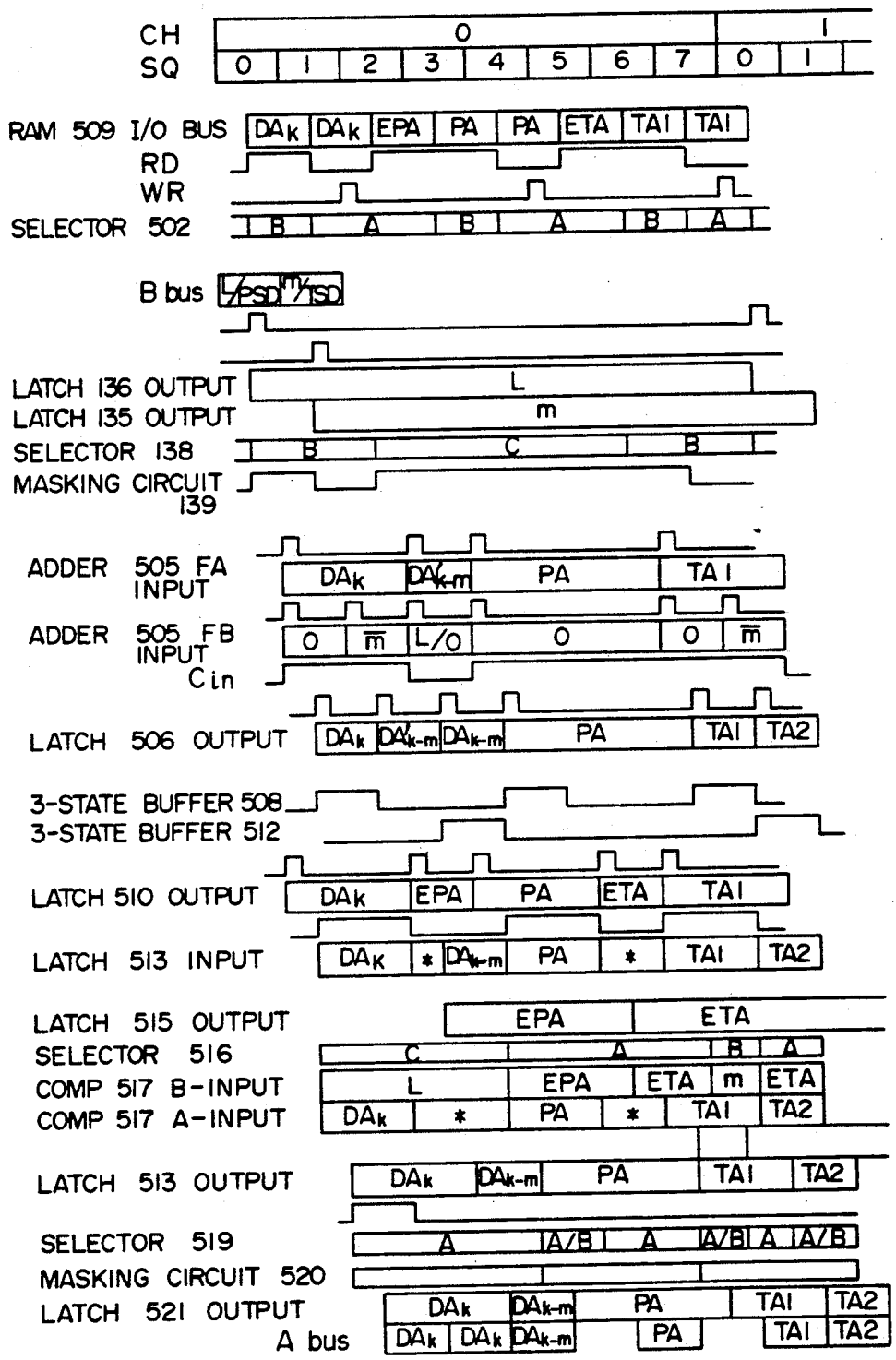
FIG. 14 is a timing chart indicative of the operation of the address generator 64.

FIG. 14 is a timing chart indicative of the operation of the apparatus of FIG. 13 when the value of ISF is not 1.

Figure 15:
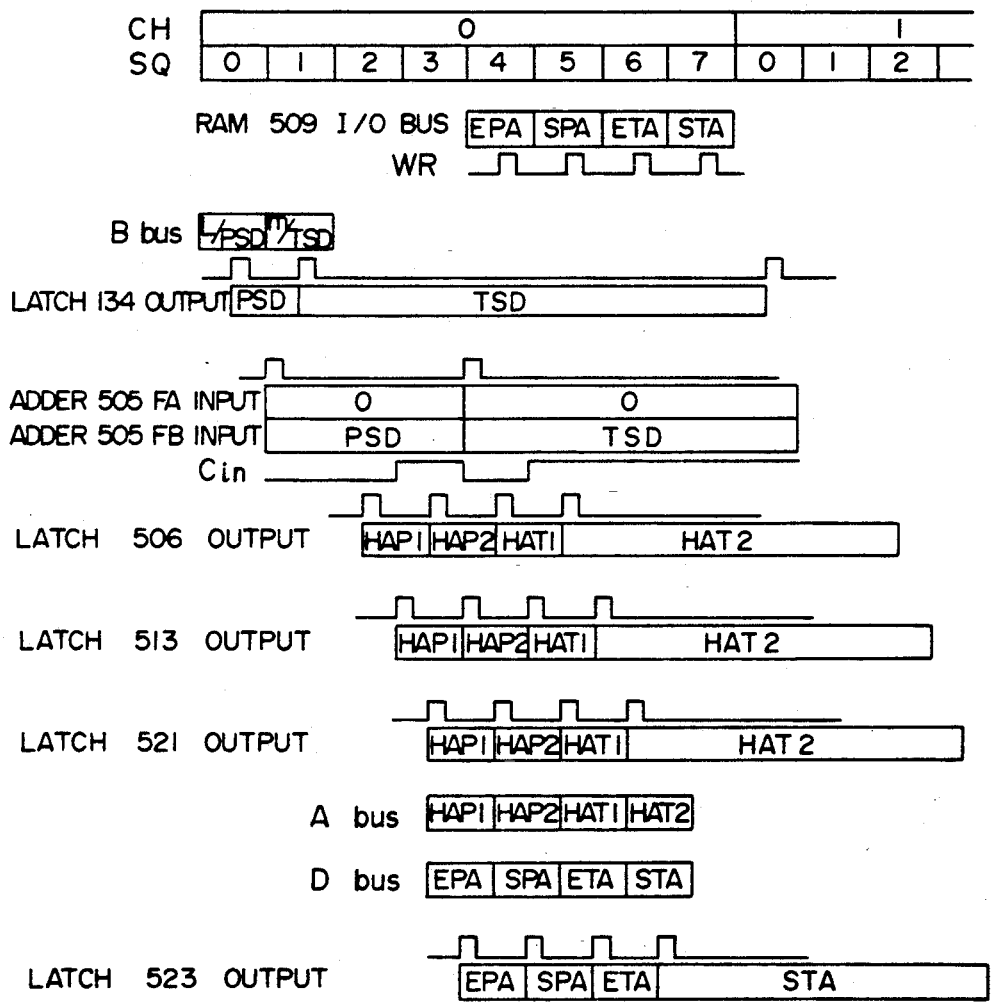
FIG. 15 is a timing chart indicative of the operation of the address generator 64.

FIG. 15 is a timing chart indicative of the operation of the circuit of FIG. 13 when the value of ISF is 1.

Figure 16:
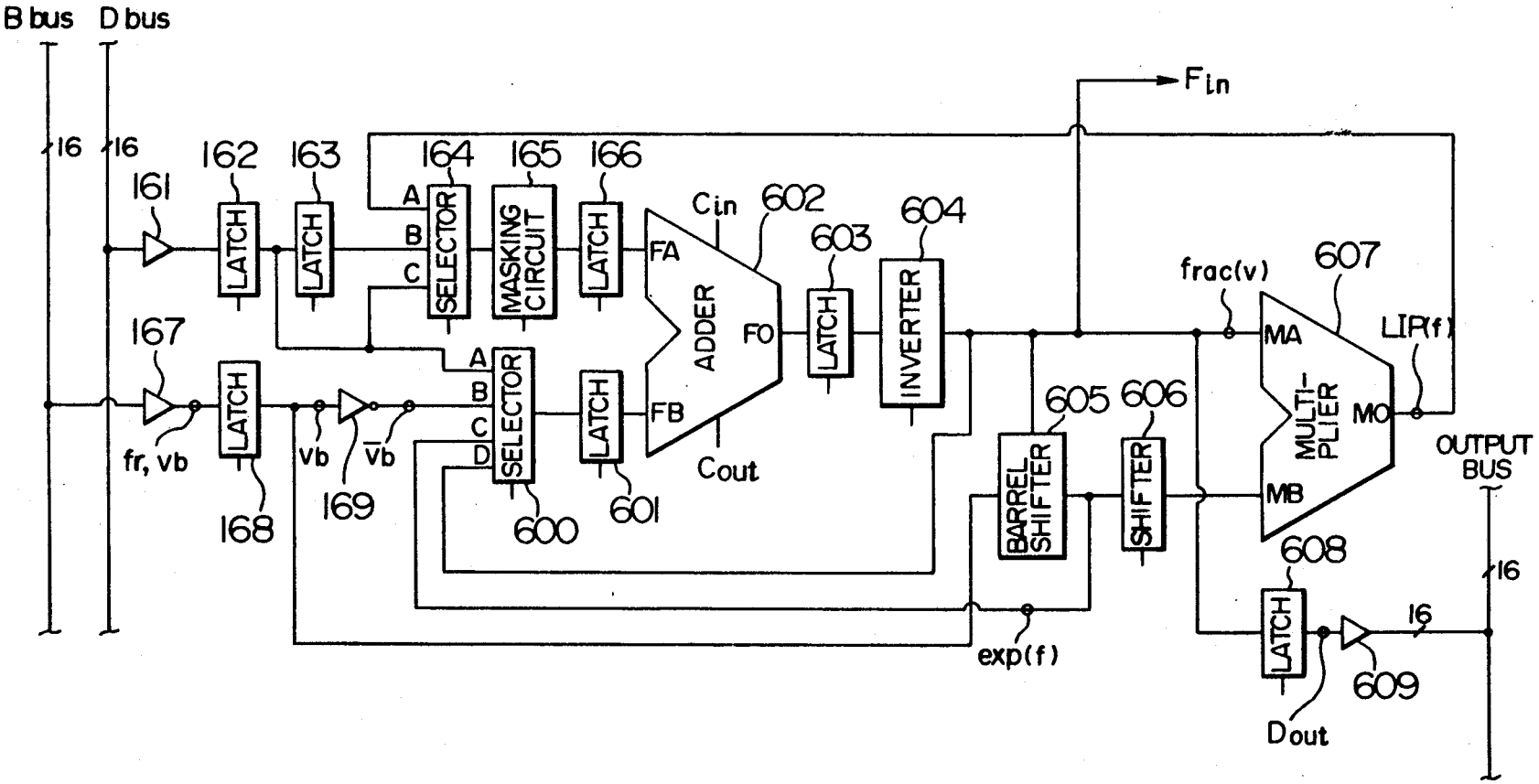
FIG. 16 is a circuit diagram of a data processor (part 1)

FIG. 16 is a diagram of a circuit which performs processing corresponding to those of adders 12, 22 and driver 21 of FIGS. 1–4. The operation of the present circuit will be outlined. First, the operation corresponding to that of driver 21 of the apparatus of FIG. 2, namely, calculation of equations 7 and 6 (note that symbols are changed; DD[k]43 $DD_k$, DD[m]→$DD_{k-m}$), are executed. Next, an operation corresponding to that of the driver 11 of FIG. 1 and addition corresponding to those of adders 12 and 22 of FIGS. 1 and 2, respectively, are performed. Lastly, the result of the addition is provided as output data Dout to DAC. while the calculation of Δv of equation 6 is performed by referring to a table corresponding to the characteristic diagram of FIG. 31 in the conventional apparatus, it is performed in an approximate from in the present embodiment by $$\Delta v=(-sgn(V))\times fr\times 2^{-(abs(vint))}\,(1-abs(vfrac)/2) \qquad (9)$$

where sgn(v) is the sign of v, abs(vint) is the absolute value of the integer portion of v, and abs(vfrac) is the absolute value of the fractional portion of v.

Figure 17:
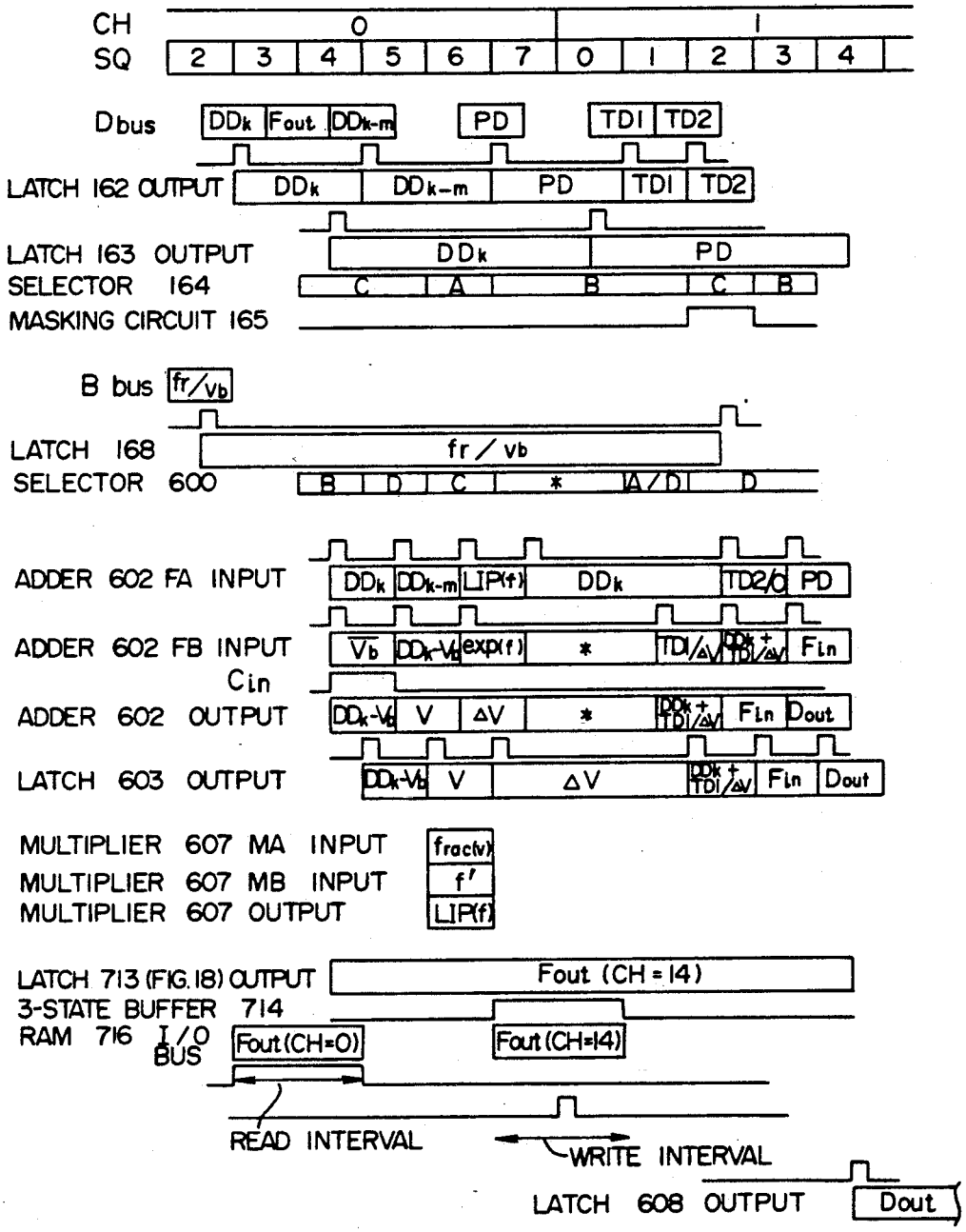
FIG. 17 is a timing chart indicative of the operation of the data processor 65 (part 1)

Here, the symbols are changed; namely, abs(vfrac)→frac(v), abs(vint)→int(v), fr× $2^{-(abs(vint))}$→exp(f), exp(f)/2→f', and fr× $2^{-(abs(vint))}$×abs(vfrac)/2→LIP(f) in order to cause the symbols to coincide with those of FIGS. 16 and 17. Equation 8 is then changed as follows:

$$\Delta v=(-sgn(v))\times(exp(f)-LIP(f)) \qquad (10)$$

In FIG. 16, reference numeral 161 denotes a buffer which fetches from Dbus delayed data $DD_k$, $DD_{k-m}$, PCM data PD, input data TD1, TD2; 162 denotes a latch which latches the output of buffer 161; 163 denotes a latch which latches the output of latch 162; 164 denotes a selector which selects one of LIP(f) output from multiplier 607, $DD_k$, $DD_{k-m}$, TD2 outputted from latch 162, and PD outputted from latch 163; 165 denotes a masking circuit which resets TD2 when a musical sound of the type generated by rubbing strings is synthesized; 166 denotes a latch which latches the output of masking circuit 165; 167 denotes a buffer which fetches playing data DT2 shown FIG. 12 from Bbus; 168 denotes a latch which latches the output of buffer 167; 169 denotes an inverter which inverts $v_b$ of playing data DT2; 600 denotes a selector which selects TD1 outputted from latch 162, $\bar{v}_b$ outputted from inverter 169, exp(f) outputted from barrel shifter 605 which shifts fr in accordance with int(v) and calculates exp(f), or $DD_k-v_b$, exp(f), Δv, Fin or Dout outputted from inverter 604; 601 denotes a latch which latches data output selector 600; 602 denotes an adder which performs subtraction by equations 6 and 10, addition by equation 8, subtraction to obtain input data TD1-TD2 (note that the input data is different in sign from TD[i]−TD[i−m]) from driver 11, the addition of input data performed by adder 12 of FIG. 1 and adder 22 of FIG. 2, and the addition of PCM data by adder 42 of FIG. 4; 603 denotes a latch which latches data outputted from adder 602; 604 denotes an inverter which takes the absolute value of vint and vfrac (for example, inverts vint, vfrac in accordance with sign bit) and determines the sign of Δv in accordance with sgn(v); 606 denotes a shifter which calculates f' which is exp(f)/2; 607 denotes a multiplier which calculates LIP(f) by multiplying frac(v) by f'; 608 denotes a latch which latches Dout; and 609 denotes a buffer which outputs Dout on the output bus.

FIG. 17 is a timing chart indicative of the operation of the circuit of FIG. 16.

Figure 18:
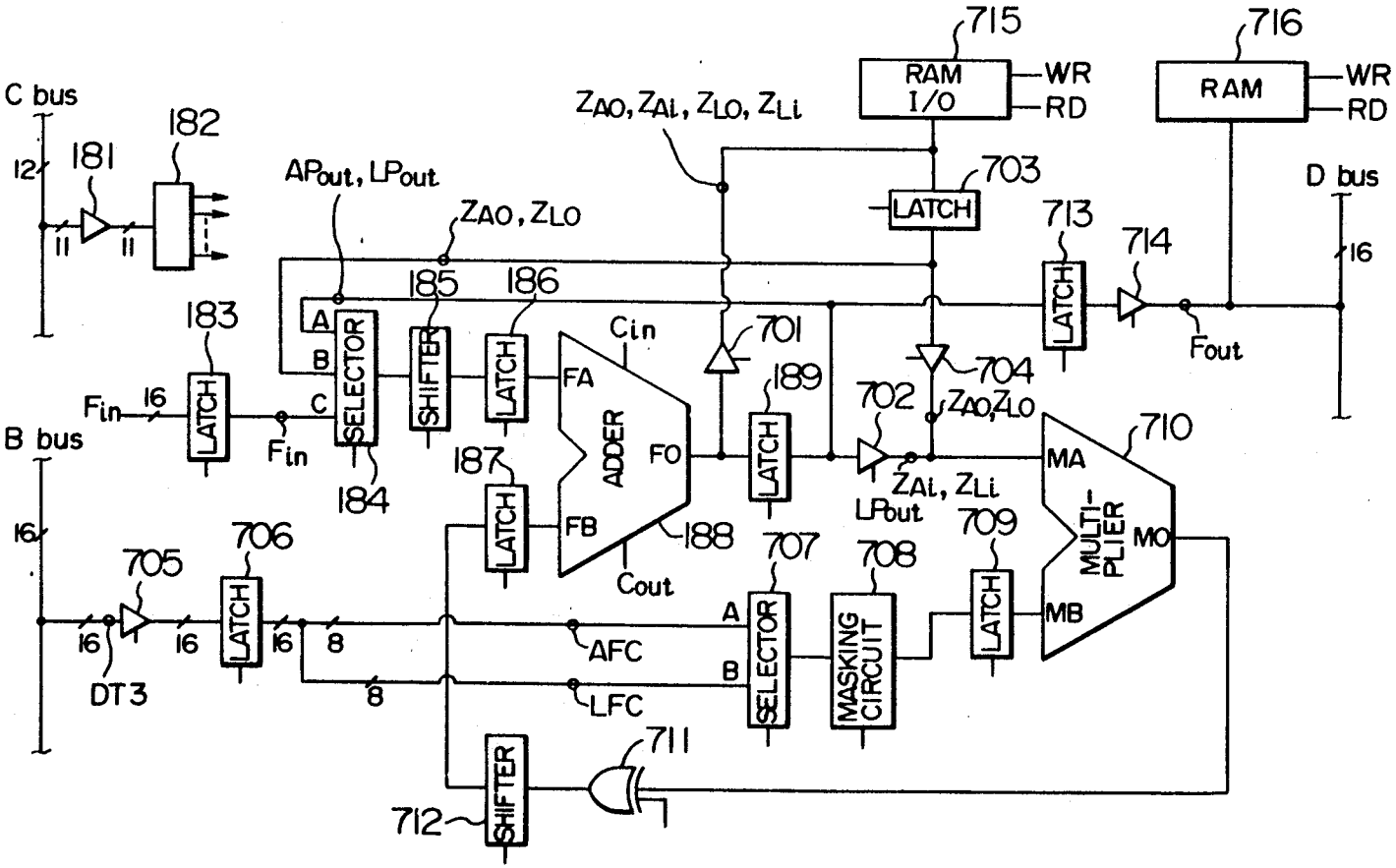
FIG. 18 is a circuit diagram of the data processor 65 (part 2)
Figure 20:
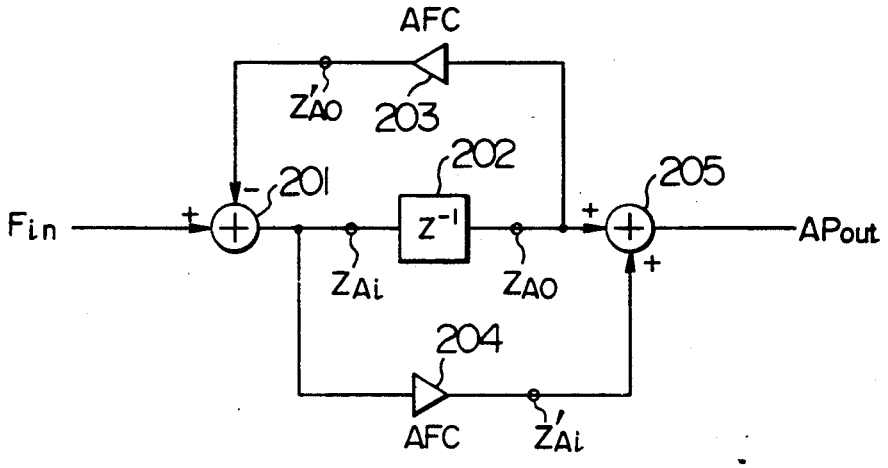
FIG. 20 is a circuit diagram of an all-pass filter operating in the circuit of FIG. 18.
Figure 21:
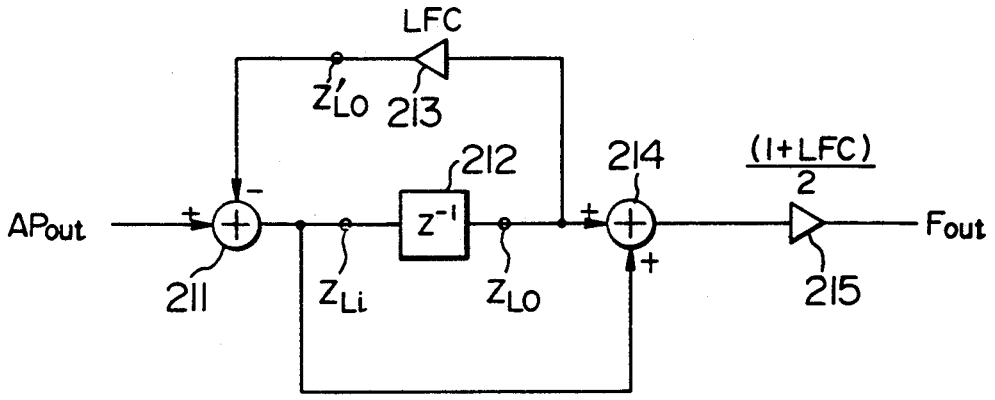
FIG. 21 is a circuit diagram of a low pass filter operating in the circuit of FIG. 18.

FIG. 18 is a diagram of a circuit of data processor 65 which performs processing corresponding to that of the low pass filter of FIG. 21 (corresponding to low pass filter 14 of FIGS. 1–4) and that of the all-pass filter of FIG. 20 (corresponding to all-pass filter 277 in delay units 13, 23). The contents of the operation performed by the present circuit will be outlined. The calculating operation of the low pass filter and all-pass filter is performed on the basis of playing data DT3 (filter coefficient) inputted via Bbus and FIN inputted from the circuit of FIG. 16. The calculated Fout is written into RAM 716 and the Fout calculated previously by the same channel is outputted onto Dbus and written into storage 66 corresponding to delay units 13, 23.

In FIG. 18, reference numeral 181 denotes a buffer which buffers Cbus; 182 denotes a control signal generator which generates a control signal for the circuits of FIGS. 16 and 18 in accordance with the output from buffer 181; 183 denotes a latch which latches Fin calculated by the circuit of FIG. 16; 184 denotes a selector which selects APout, LPout from latch 189, or $Z_{Ao}$, $Z_{Lo}$ from latch 703, or $F_{in}$ from latch 183; 185 denotes a shifter which performs a shifting operation for half of (1+LFC)/2 shown in FIG. 21; 186 denotes a latch which latches the output from shifter 185; 187 denotes a latch which latches the output from shifter 712; 188 denotes an adder which performs addition and subtraction corresponding to those of subtracter 201 and adder 205 of FIG. 20, and subtraction and addition of subtracter 211 and adder 214 of FIG. 21, respectively; 189 denotes a latch which latches the result of the addition by adder 188; 701 denotes a 3-state buffer which causes $Z_{Ao}$, $Z_{Ai}$, $Z_{Lo}$ and $Z_{Li}$ of the results of the addition by adder 188 to pass therethrough when they are written into RAM 715; 702 denotes a 3-state buffer which inputs $Z_{Ai}$, $Z_{Li}$, LPout of the outputs from latch 189 to MA input of multiplier 710 which performs multiplication corresponding to those of multipliers 203 and 204 of FIG. 20 and of multipliers 213 and 215 of FIG. 21; 703 denotes a latch which latches the output of RAM 715; 704, denotes a 3-state buffer which inputs $Z_{Ao}$, $Z_{Lo}$ from latch 703 to MA input of multiplier 710; 705 denotes a buffer which fetches DT3 (filter coefficients) of playing data from Bbus; 706 denotes a latch which latches the output of buffer 705; 707 denotes a selector which selects AFC comprising A input (filter coefficients of the all-pass filter of FIG. 20) or LFC comprising B input (filter coefficients of the low pass filter of FIG. 21); 708 denotes a masking circuit which changes the value of LFC to 1 (unity); 709 denotes a latch which latches the output of masking circuit 708; 711 denotes an XOR gate which inverts $Z_{Ao}$, $Z_{Lo}$ of the outputs from multiplier 710; 712 denotes a shifter which halves LPout' of data from XOR gate 711; 713 denotes a latch which latches Fout outputted from latch 189; 714 denotes a 3-state buffer which causes Fout from latch 713 to pass therethrough which it is written into RAM 716 which outputs onto Dbus Fout calculated previously by the same channel and which stores Fout calculated newly; and 715 denotes a RAM which stores $Z_{Ao}$, $Z_{Ai}$, $Z_{Lo}$, $Z_{Li}$.

Figure 19:
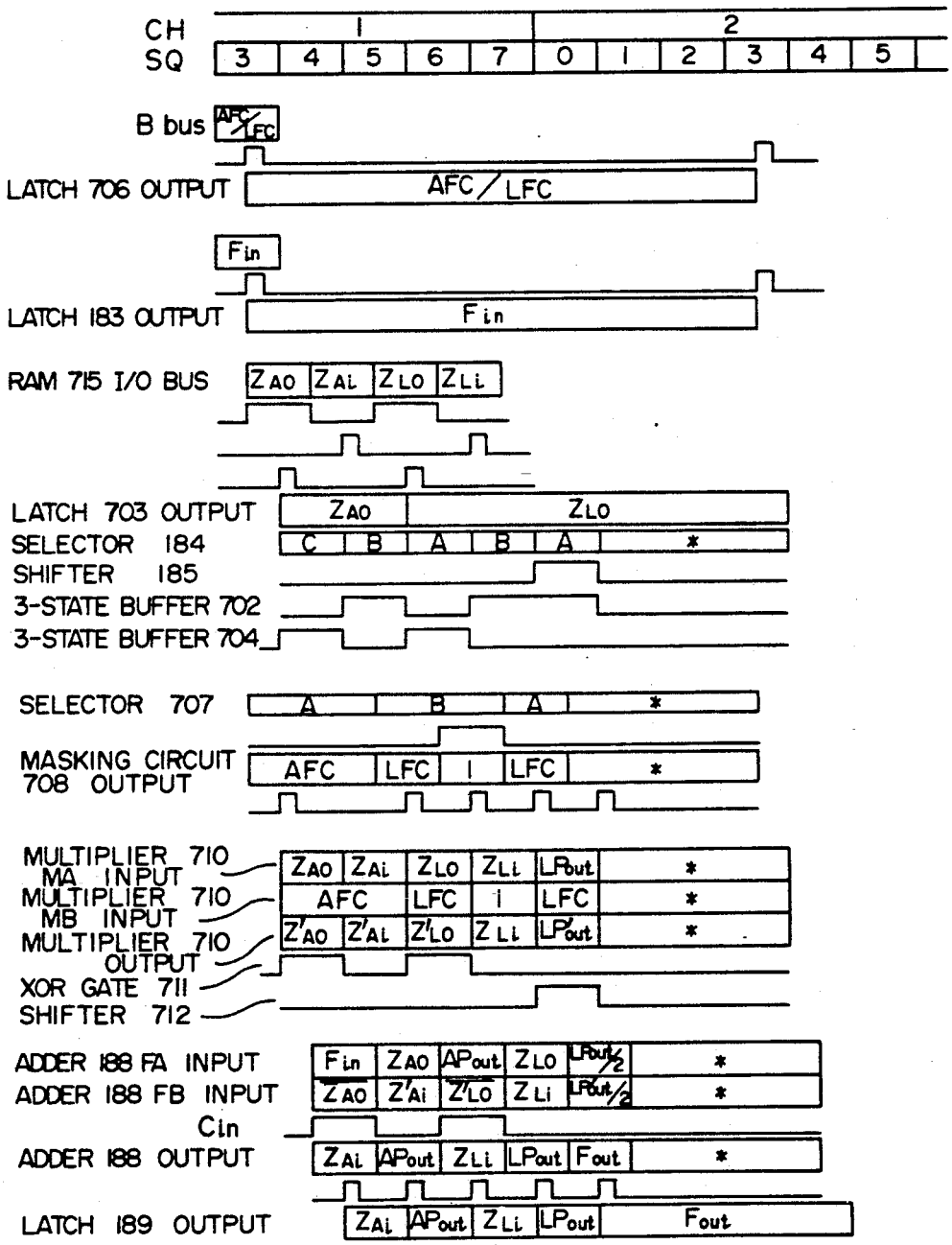
FIG. 19 is a timing chart indicative of the operation of data processor 65 (part 2)

FIG. 19 is a timing chart indicative of the operation of the circuit of FIG. 18.

FIG. 20 illustrates a circuit for performing an operation corresponding to the all-pass filter operation of the circuit of FIG. 18. In FIG. 20, reference numeral 201 denotes a subtracter which subtracts from Fin the $Z'_{Ao}$ outputted from multiplier 203; 202 denotes a delay unit which delays data $Z_{Ai}$ from adder 201 by one sample period; 203 denotes a multiplier which multiplies the data $Z'_{Ao}$ from delay unit 202 by a factor of AFC; 204 denotes a multiplier which multiplies the data $A_{Ai}$ from adder 201 by a factor of AFC; and 205 denotes an adder which data data $Z'_{Ao}$ from delay unit 202 and data $Z'_{Ai}$ from multiplier 204.

FIG. 21 shows a circuit which performs an operation corresponding to the low pass filter operation performed by the circuit of FIG. 18. In FIG. 21, reference numeral 211 denotes a subtracter which subtracts from APout the output $Z'_{Lo}$ from multiplier 213; 212 denotes a delay unit which delays data $Z_{Li}$ from adder 211 by one sample period; 213 denotes a multiplier which multiplies the data $Z_{Lo}$ from delay unit 212 by a factor of LFC; 214 denotes an adder which adds data $Z_{Lo}$ from delay unit 212 and data $Z_{Li}$ from adder 211; and 215 denotes a multiplier which multiplies the output of adder 214 by a factor of (1+LFC)/2.

FIG. 22A shows a memory map in storage 66. In FIG. 22A, addresses 0000*h* to 6FFF*h* belong to a RAM delay area corresponding to delay units 13, 23; addresses 7000*h* to 7FFF*h*, a ROM input data area which stores input data TD[i]−TD[i−m] from driver 11; and addresses 8000*h* -FFFF*h*, a ROM PCM data area which stores PCM data PD from PCM generator 41. Address 40*h* in each of the areas of ROM belongs to the header area which stores the start and end addresses of the input data and PCM data.

FIG. 22B shows the address format of storage 66. In FIG. 22B, a portion b10–13 of the delay area address format is formed of CH-bits and used to distinguish the delay area.

FIG. 22C shows the address format of the header area in the storage 66 ROM.

In FIGS. 22B and C, b0 of each address format designates the address where the end address is stored when b0 is 0, and the address where the start address is stored when b0 is 1.

Figure 23:
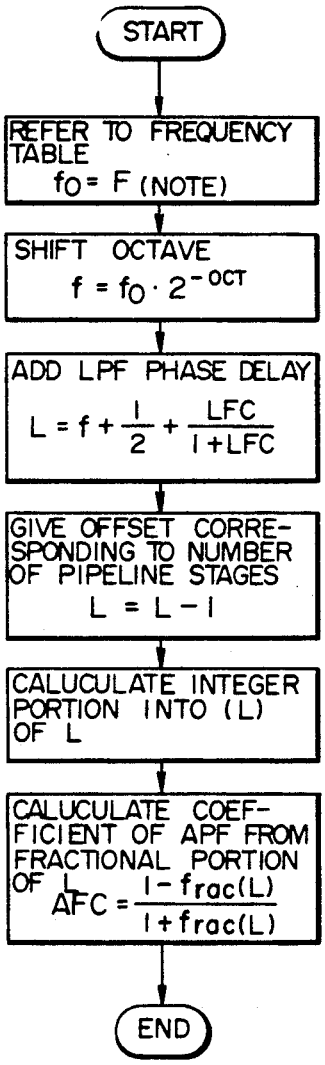
FIG. 23 is a flowchart indicative of the contents of the operation of a microcomputer 61.

FIG. 23 shows the contents of operation of microcomputer 61 in a flowchart.

Figure 24A:
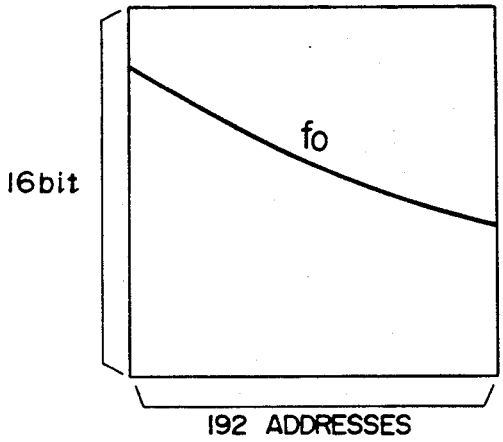
FIG. 24A shows a table which stores frequency data f0.

FIG. 24A illustrates a frequency table in microcomputer 61.

Figure 24B:
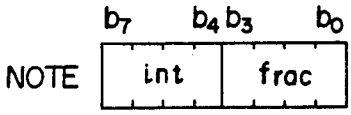
FIG. 24B shows the address format of the table.

FIG. 24B illustrates the address format in the frequency table. In FIG. 24B, the symbol int in b4−7 of NOTE denotes bits which distinguish 12 individual scales in one octave while the symbol frac denotes bits which represent the contents of the minimum unit (100 cents) of int in more detail.

Figure 24C:
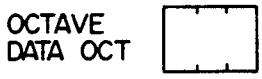
FIG. 24C shows the format of octave data OCT.

FIG. 24C illustrates the data format of data OCT designating an octave.

Figure 25A:
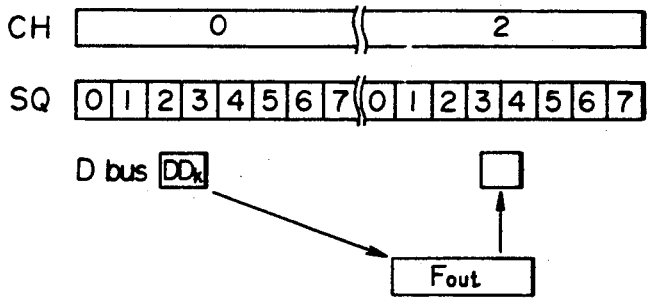
FIGS. 25A B are timing charts indicative of read/-write operations of delayed data $DD_k$ in storage 66.
Figure 25B:
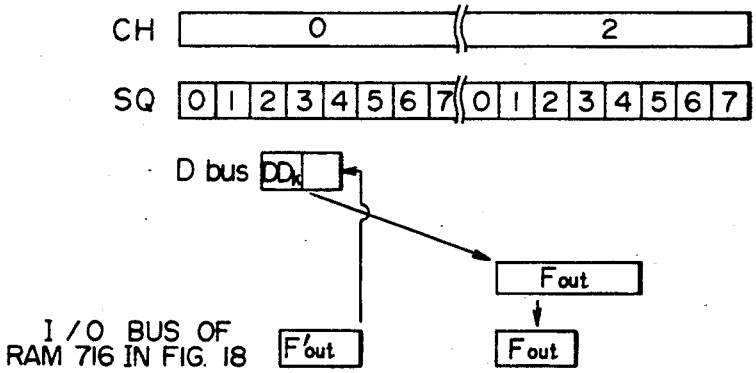
Figure 27:
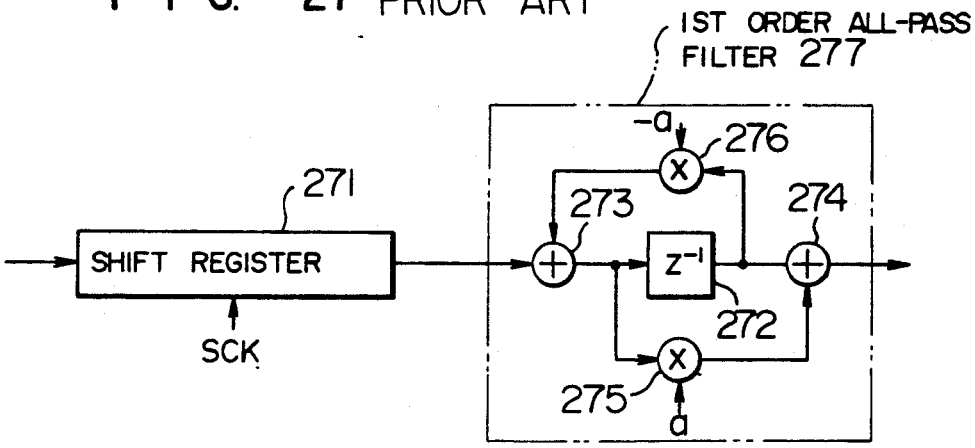
FIG. 27 PRIOR ART
FIG. 27 is a circuit diagram of each of delay units 263, 264 269 and 401.

FIGS. 25A and B illustrates the read/write operations of delayed data $DD_k$ in storage 66. In FIG. 25A, the circuit of data processor 65 (FIG. 18) is not pipelined, while in FIG. 25B the circuit is pipelined. In FIG. 25A, delayed data $DD_k$ is read from storage 66 and Fout is calculated on the basis of $DD_k$ by the calculations of FIGS. 16 and 18. Fout is written again into storage 66 in which case the write timing is in the interval during which processing of channel 2 is performed, so that the circuit of address generator 64 which manages the addresses of storage 66 becomes complicated. In FIG. 25B, delayed data $DD_k$ is read from storage 66 as in FIG. 25A, and Fout is calculated by the operations of FIGS. 16 and 18 on the basis of $DD_k$ What is different from FIG. 25A is that reading $DD_k$ is performed simultaneously with writing into storage 66 the result of the preceding calculation Fout stored in RAM 716 (FIG. 18). In this case, additional provision of RAM 716 is required, but the address management of storage 66 by address generator 64 is facilitated. The explanation of the function of RAM 716 will be supplemented. Since the present embodiment is a musical sound synthesizing apparatus which is capable of synthesizing musical sounds for 16 channels, the structure of the address generator 64 becomes only complicated if RAM 716 is not provided (FIG. 25A), as mentioned above. For example, if a musical sound synthesizing apparatus which only synthesizes a musical sound for one channel is designed, one sample period is determined by the time interval from the reading of $DD_k$ to the determination of Fout as shown in FIG. 25A, so that the quality of the synthetic sound is deteriorated unless pipelining including the provision RAM 716 which functions as a data buffer for pipelining purposes is performed.

The operation of the musical sound synthesizing apparatus having the above structure will now be described with reference to FIGS. 6–FIGS. 25A and B. Channels 0–15 perform the same processing on a time-divisional basis, so that only the processing by channel 0 will be described for simplifying purposes.

First, the synthesization of a musical sound of the type generated by touching or hitting strings (the processing by the apparatus of FIG. 1) and the synthesization of a sound generated by a device other than a mechanism for vibrating strings (the processing of the apparatus of FIG. 4) will be described. In the musical sound synthesizing apparatus of FIG. 6, playing data (FIG. 12) is inputted to input interface 62 via the input bus from microcomputer 61. In the sequence in which pieces of the playing data are inputted, DT0 (data including kon to generate ISF) of FIG. 12 must be inputted after DT1, 2, 3, because inputting data to determine a tone color or a pitch is required to be completed before or at the same time as system controller 63 generates ISF. The playing data is stored in RAM 109 of FIG. 10 and the kon bit of DT0 is latched in latch 73 of FIG. 7. If the kon latched previously is 0, AND gate 75 outputs ISF to Cbus (for the interval shown in FIG. 9). This causes the address generator 64 of FIG. 13 to be put in an operational mode shown in FIG. 15 in which the address generator 64 fetches PSD, TSD of DT0, DT1 of FIG. 12 from Bbus to generate the address of each header area in the storage 66 (FIG. 22A). The address generator reads from storage 66 the end address EPA and start address SPA of PCM data PD and the end and start addresses ETA and STA of input data TD corresponding to the header area address. Finally, the read pieces of data are stored in RAM 509 (FIG. 13). In the next channel 0 processing which is performed one sample period of 25.6 microseconds later, as shown in FIG. 8, the address generator 64 performs the processing of FIG. 14 in which addresses $DA_k$, $DA_{k-m}$ of the delay data, the address PA of PCM data PD, and addresses TA1, TA2 of input data TD1 (TD[i]), TD2 (TD[i−m]) are calculated. During ISF, $DD_k$ is reset to 0 by masking circuit 507 of FIG. 13 and PA, TA1 are preset at start addresses SPA and STA read from storage 66 in preparation for the synthesization, as mentioned above. Addresses $DA_k$, $DA_{k-m}$, PA, TA1 and TA2 are outputted to storage 66 and delayed data $DD_k$, $DD_{k-m}$ and PCM data PD and input data TD1, TD2 are read into data processor 65 via Dbus (FIG. 16). In the circuit of FIG. 16, $DD_k$ is added to TD1 and TD2 to calculate Fin, which is then outputted to the circuit of FIG. 18 and to DAC. In FIG. 18, Fin is processed into Fout by the operation of the all-pass filter (FIG. 20) and the low pass filter (FIG. 21) and the resulting data is stored in RAM 716. The data written from RAM 716 into the storage 66 delay area via Dbus is Fout' calculated in the preceding channel 0 processing. By repeating the above processing, a desired musical sound is synthesized. The PCM data PD is obtained by sampling a signal indicative of sounds generated by a device other than the mechanism for vibrating the string and storing beforehand in storage 66.

The synthesization of a musical sound of the type generated by rubbing strings (the processing of the apparatus of FIG. 2) will be described. The musical sound generated by rubbing strings differs in synthesization from that generated by touching or hitting strings, as shown by the contents of the operation of FIG. 16 in which case Δv is obtained by the calculation of Δv shown in FIG. 17, and $DD_k$ is added to Δv to obtain Fin.

Lastly, an operation corresponding to that of the apparatus of FIG. 3 will be described. The feature of the apparatus of FIG. 3 lies in that the pitch of a musical sound does not change even if the high frequency cutoff characteristic of the low pass filter 14 is controlled. The musical sound synthesizing apparatus of FIG. 6 performs an operation corresponding to those features using microcomputer 61.

First, in FIG. 23, the filter coefficient LFC is changed to control the high frequency cutoff characteristic of the low pass filter (FIG. 21). The phase delay of the low pass filter (FIG. 21) is approximated as $(\frac{1}{2})+\{LFC/(1+LFC)\}$, so that the word length L of the delay unit including the phase delay of the low pass filter (FIG. 21) is given by $$L=f+(\tfrac{1}{2})+\{LFC/(1+LFC)\} \quad (10)$$

where f is a value obtained from the frequency table of FIG. 24.

The integer word length int (L) of the delay unit (word length per channel of storage 66) and a fractional word length frac (L) are calculated from L. The filter coefficient AFC of the all-pass filter (FIG. 20) is calculated approximately from the fractional word length frac (L). As shown in FIG. 23, processing is included which gives an offset for the number of pipeline stages which is an excess delay quantity resulting from writing Fout in storage 66 by shifting Fout by a time for one channel using RAM 716 (FIG. 18). Since the delay quantity displaces the musical sound by one delay quantity, an offset (excess delay quantity) is subtracted beforehand.

Figures 28A, 28B, 28C:
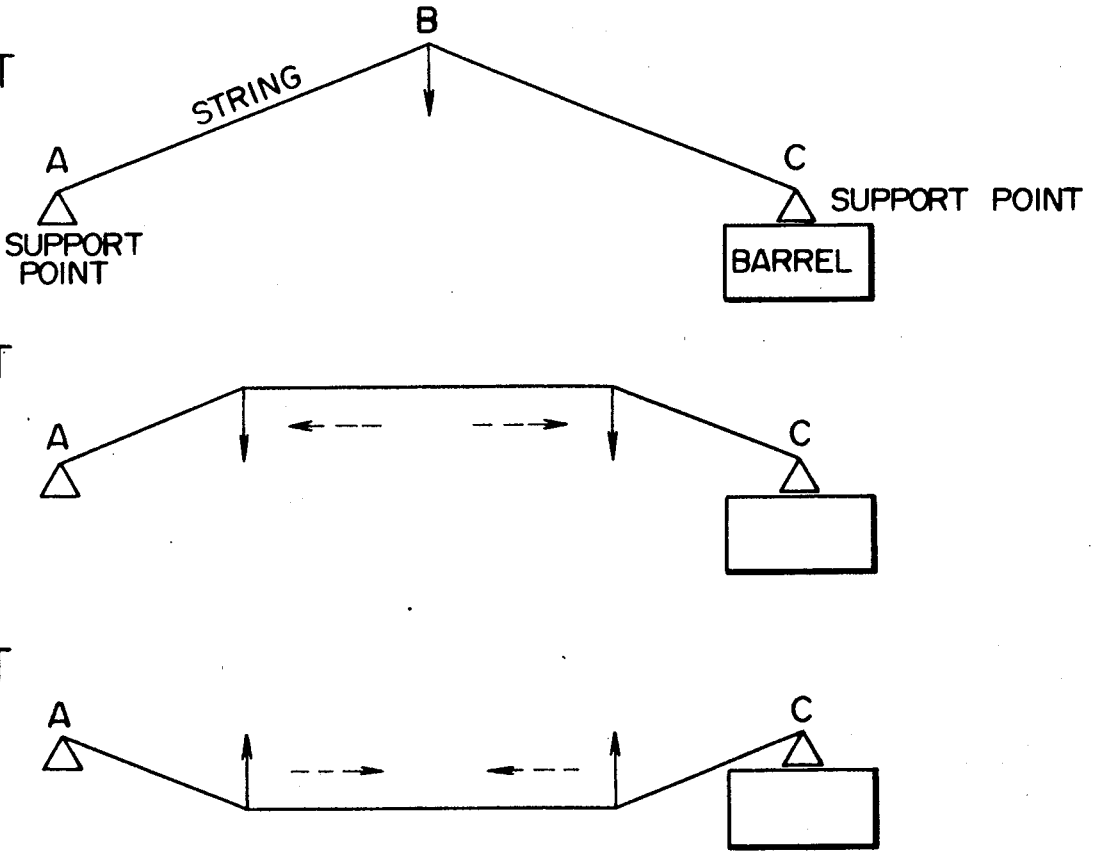
FIG. 28A PRIOR ART
FIG. 28B PRIOR ART
FIG. 28C PRIOR ART
FIG. 28A, B and C schematically illustrate a sound generating mechanism of an instrument of the type in which strings are touched.
Figure 29A:
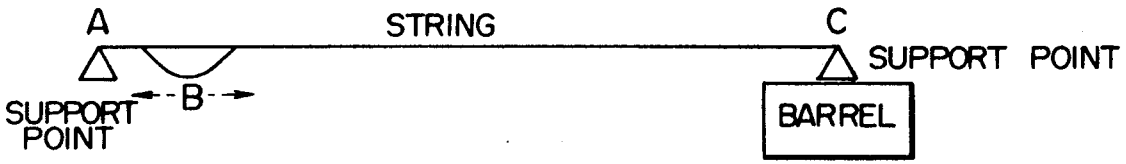
FIG. 29A PRIOR ART
FIGS. 29A, B and C schematically illustrate a generating mechanism of an instrument of the type in which strings are hit.
Figure 29B:
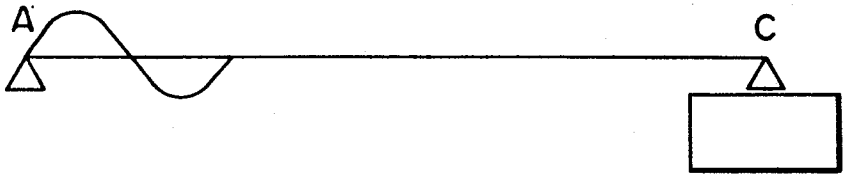
FIG. 29B PRIOR ART
Figure 29C:
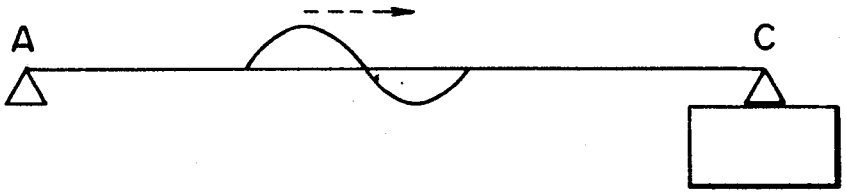
FIG. 29C PRIOR ART

As described above, the present embodiment includes storage 66 having the delay area, input data area and PCM data; address generator 64 which reads delayed data $DD_k$, $DD_m$, input data TD1, input data TD2 delayed from TD1 by a time interval m corresponding to the distance between A and B of FIGS. 28 and 29, and PCM data corresponding to a sound generated by an operation other than vibrations of strings; and data processor 65 which calculates Fin on the basis of $DD_k$, $DD_m$, TD1, TD2 ,and input data $v_b$ from microcomputer 61, as shown in FIG. 16, and which filters Fin to obtain Fout, as shown in FIG. 18. Thus, the embodiment has a simplified circuit as compared with the conventional one in order to synthesize a musical sound similar to that generated by touching, hitting or rubbing strings.

Provision of microcomputer 61 which is capable of controlling the word length of the delay unit in accordance with the high frequency cutoff characteristic of the low pass filter serves to maintain the pitch of a synthetic sound at a constant value.

Provision of microcomputer 61 which beforehand subtracts from L the number of pipeline stages, which is 1, serves to maintain the pitch of the synthetic sound at a constant value.

Storage 66 is provided having PCM data obtained by sampling a signal indicative of sounds generated by an operation other than vibrations of strings. The PCM data and the synthetic sound data corresponding to vibrations of the string are added to synthesize a sound generated by an operation other than vibrations of strings.

As mentioned above, according to the embodiment of FIG. 1, a simple circuit structure including the driver 11 which receives input data TD[i]−TD[i−m], the adder which adds input data and the output data from the low pass filter, the delay unit which stores the result of the addition temporarily, and the low pass filter which processes the data from the delay unit, serves to synthesize a musical sound such as that obtained by touching or hitting strings.

According to the embodiment of FIG. 2, a simple circuit structure including the driver which calculates acceleration data Δv on the basis of input data $v_b$, data from the low pass filter, and data DD[k], DD[m] from the delay unit; the adder which adds the acceleration data Δv and the data from the low pass filter; and the delay unit for storing the result of the addition temporarily, the low pass filter processing the data DD[k] from the delay unit, serves to synthesize a musical sound of the type generated by rubbing the string.

In the musical sound synthesizing apparatus according to the present invention, provision of the word length designating unit, which corrects the word length of the delay unit in accordance with the control of the high frequency cutoff characteristic of the low pass filter, serves to maintain the pitch of a synthetic sound at a constant value without depending on the value of the filter coefficient.

In the musical sound synthesizing apparatus according to the present invention, provision of a loop-like circuit comprising the adder, delay unit and low pass filter, and the word length designating unit which, when the loop-like circuit is pipelined, corrects the word length of the delay unit by the number of pipeline stages, serves to correct the pitch of a synthetic sound easily.

According to the embodiment of FIG. 4, provision of the PCM generator and the adder serves to synthesize a sound generated by an operation other than vibrations of a string.

What is claimed is:

1. A musical sound synthesizing apparatus comprising:

a musical sound synthesizing means including an electronic circuit means for simulating a sound generating mechanism of a string instrument having a string; and a driver means for applying to said musical sound synthesizing means difference data TD(i)−TD(i−m) of an input data train TD which is obtained by subtracting pulse code modulated data TD(i−m) stored at an address i−m in said driver means from pulse code modulated data TD(i) stored at an address i in said driver means where i and m are integers designating an address of the input data train TD such that TD(i−m) constitutes data in said data train TD which is m unit times before TD(i); and a controller means for applying to said driver means said integer m to determine the address i−m, said integer m being determined by a position on the string of said instrument at which the string is touched or hit, said musical sound synthesizing means further comprising:

a low pass filter means;

an adder means for adding together said difference data TD(i)−TD(i−m) from said driver means and output data DD'(k) from said low pass filter means;

a delay means for storing output data from said adder means temporarily and providing output data DD(k), k being an integer, said output data DD(k) being data which is input to said delay means from said adder and which is k unit times earlier than output data presently being output by said adder; and a word length designating means for designating a word length of said delay means to control said integer k, said low pass filter means processing said output data DD(k) read out from said delay means and producing resulting filtered output data DD'(k) which is input to said adder means.

2. A musical sound synthesizing apparatus according to claim 1, wherein said word length designating means determines the word length of said delay means in accordance with a parameter for controlling the high frequency cutoff characteristic of said low pass filter means.

3. A musical sound synthesizing apparatus comprising:

a control means for producing a parameter m corresponding to a position on a string at which the string is plucked or hit, where m is an integer;

a storage means for storing data TD(i) of a data train TD corresponding to an initial input waveform input thereto at the time when the string is plucked or hit, where i is an integer designating an address within data rain TD;

a driver means for calculating data TD(i)−TD(i−m) based on the parameter m input from said control means and the data TD(i) read out of said storage means, where TD (i−m) designates an address of said input data train TD which is m unit times before address TD(i);

a delay means for delaying data inputted thereto by a designated delay time period;

a word length designating means for designating the delay time period of said delay means;

a low pass filter means for attenuating high frequency band components of data input thereto from said delay means; and an adder means for adding the data TD(i)−TD(i−m) calculated by said driver means to data input thereto from said low pass filter means and for inputting a result of the addition to said delay means.

4. A musical sound synthesizing apparatus according to claim 2, wherein said word length designating means designates the delay time period of said delay means based on a parameter which controls a high frequency band component attenuating characteristic of said low pass filter means.

5. A musical sound synthesizing apparatus comprising:

a control means for producing a parameter m corresponding to a position on a string at which the string is plucked or hit, where m is an integer;

a storage means for storing data TD(i) of a data train TD corresponding to an initial input waveform input thereto at the time when the string is plucked or hit, where i is an integer designating an address within data train TD;

a driver means for calculating data TD(i)−TD(i−m) based on the parameter m input from said control means and the data TD(i) read out of said storage means, where TD(i−m) designates an address within said input data train TD which is m unit times earlier than TD(i);

a low pass filter means for attenuating high frequency band components of data input thereto;

a delay means for delaying data input thereto from said low pass filter means by a designated delay time period;

a word length designating means for designating the delay time period of said delay means; and an adder means for adding the data TD(i)−TD(i−m) calculated by said driver means to data input from said delay means and for inputting a result of the addition to said low pass filter means.

6. A musical sound synthesizing apparatus according to claim 5, wherein said word length designating means designates the delay time period of said delay means based on a parameter which controls a high frequency band component attenuating characteristic of said low pass filter means.

* * * * *